US007985149B2

(12) United States Patent
Watari et al.

(10) Patent No.: US 7,985,149 B2
(45) Date of Patent: Jul. 26, 2011

(54) BAT FOR BASEBALL OR SOFTBALL

(75) Inventors: Makoto Watari, Yokohama (JP); Katsumi Shimohira, Yokohama (JP); Yuta Okutsu, Yokohama (JP)

(73) Assignee: Nippon Shaft Co., Ltd., Yokohama-shi, Kanagawa (JP)

( * ) Notice: Subject to any disclaimer, the term of this patent is extended or adjusted under 35 U.S.C. 154(b) by 86 days.

(21) Appl. No.: 12/494,357

(22) Filed: Jun. 30, 2009

(65) Prior Publication Data

US 2010/0125014 A1 May 20, 2010

(30) Foreign Application Priority Data

Nov. 17, 2008 (JP) ..... 2008-293791

(51) Int. Cl.
*A63B 59/06* (2006.01)

(52) U.S. Cl. ..... 473/566; 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 5,954,602 | A | 9/1999 | Eggiman et al. | |
| 6,776,735 | B1 | 8/2004 | Belanger et al. | |
| 6,808,464 | B1 | 10/2004 | Nguyen | |
| 6,872,156 | B2 * | 3/2005 | Ogawa et al. | 473/567 |
| 6,875,137 | B2 | 4/2005 | Forsythe et al. | |
| 6,969,330 | B1 | 11/2005 | Meeker | |
| 7,014,580 | B2 | 3/2006 | Forsythe et al. | |
| 7,033,291 | B1 | 4/2006 | Meeker | |
| 7,128,670 | B2 | 10/2006 | Souders et al. | |
| 7,361,107 | B2 | 4/2008 | Giannetti et al. | |
| 7,534,180 | B1 | 5/2009 | Vacek et al. | |
| 7,749,115 | B1 | 7/2010 | Cruz et al. | |
| 7,850,554 | B2 | 12/2010 | Burger | |
| 7,867,114 | B2 | 1/2011 | Sutherland et al. | |
| 2002/0091022 | A1 * | 7/2002 | Fritzke et al. | 473/566 |
| 2002/0094892 | A1 | 7/2002 | Chauvin et al. | |

(Continued)

FOREIGN PATENT DOCUMENTS

JP 05-057042 3/1993

(Continued)

OTHER PUBLICATIONS

Makoto Watari, et al., U.S. Appl. No. 11/878,935, filed Jul. 27, 2007, Specification, Claims, Abstract and Drawings.

(Continued)

*Primary Examiner* — Mark S Graham
(74) *Attorney, Agent, or Firm* — Nixon Peabody LLP; Jeffrey L. Costellia

(57) ABSTRACT

A bat for baseball or softball of the present invention includes a first tube formed from FRP or synthetic resin having a part to be hit and a stopper part, a cylindrical second tube having two ends which are open and including at least two or more layers, a first fixing component including a body part, an interior periphery surface of the body part is fixed to the first tube, a second fixing component including an insertion part, and a gap located between the first tube and the second tube and being formed by the second tube being attached to an exterior periphery of the first tube, one end of the second tube being fixed to an exterior periphery surface of the body part, and the other end of the second tube being fixed to the insertion part which is inserted between the first tube and the second tube.

19 Claims, 15 Drawing Sheets

U.S. PATENT DOCUMENTS

| | | | | |
|---|---|---|---|---|
| 2003/0153416 | A1* | 8/2003 | Anderson | 473/566 |
| 2004/0053716 | A1 | 3/2004 | Wu | |
| 2004/0224802 | A1 | 11/2004 | Forsythe et al. | |
| 2006/0258490 | A1 | 11/2006 | Fitzgerald et al. | |
| 2008/0070726 | A1 | 3/2008 | Watari et al. | |
| 2009/0280934 | A1 | 11/2009 | Watari et al. | |
| 2009/0280935 | A1 | 11/2009 | Watari et al. | |
| 2011/0105255 | A1 | 5/2011 | Watati et al. | |

FOREIGN PATENT DOCUMENTS

| | | |
|---|---|---|
| JP | 11-137752 | 5/1999 |
| JP | 2001-079131 | 3/2001 |
| JP | 2003-019236 | 1/2003 |
| JP | 2004-267478 | 9/2004 |
| JP | 2005-245943 | 9/2005 |
| JP | 2005-305146 | 11/2005 |
| JP | 2008-029620 | 2/2008 |
| JP | 57-185374 | 6/2010 |
| WO | WO 2000/23151 | 4/2000 |

OTHER PUBLICATIONS

Makoto Watari, et al., U.S. Appl. No. 12/404,604, filed Mar. 16, 2009, Specification, Claims, Abstract and Drawings.

Makoto Watari, et al., U.S. Appl. No. 12/165,718, filed Jul. 1, 2008, Specification, Claims, Abstract and Drawings.

Office Action issued in counterpart Japanese Pat. App. No. 2009-030362, dated Jun. 1, 2010.

Office Action issued in counterpart Japanese Pat. App. No. 2009-030362, dated Aug. 31, 2010.

International Search Report issued in International Application No. PCT/JP99/03723, dated Nov. 9, 1999.

Office Action of co-pending U.S. Appl. No. 12/987,429, mailed Mar. 9, 2011.

* cited by examiner (b) Line α - α' sectional view

FIG.4

| | | inner layer | | | | | | | | |
|---|---|---|---|---|---|---|---|---|---|---|
| | | aluminum | aluminum alloy | titanium | titanium alloy | magnesium alloy | aluminum-scandium alloy | aluminum-scandium alloy | FRP | steel alloy |
| outer layer (surface layer) | aluminum | △ | △ | ○ | ○ | ○ | ○ | ○ | ◎ | ○ |
| | aluminum alloy | △ | △ | ○ | ○ | ○ | ○ | ○ | ◎ | ○ |
| | titanium | ◎ | ◎ | △ | △ | ○ | ○ | ○ | ◎ | ○ |
| | titanium alloy | ◎ | ◎ | △ | △ | ○ | ○ | ○ | ◎ | ○ |
| | magnesium alloy | ◎ | ◎ | ○ | ○ | △ | ○ | ○ | ◎ | ○ |
| | aluminum-scandium alloy | ◎ | ◎ | ○ | ○ | ○ | △ | △ | ◎ | ○ |
| | scandium alloy | ◎ | ◎ | ○ | ○ | ○ | △ | △ | ◎ | ○ |
| | FRP | ◎ | ◎ | ○ | ○ | ○ | ○ | ○ | △ | ○ |
| | steel alloy | ◎ | ◎ | ○ | ○ | ○ | ○ | ○ | ◎ | △ |
| | wood | ◎ | ◎ | ○ | ○ | ○ | ○ | ○ | ◎ | ○ |

(b)Line β-β' sectional view (a) The longitudinal direction surface view (b) The longitudinal direction notch sectional view (a) The longitudinal direction surface view (b) The longitudinal direction notch sectional view

BAT FOR BASEBALL OR SOFTBALL

CROSS REFERENCE TO RELATED APPLICATION

This application is based upon and claims the benefit of priority from the prior Japanese Patent Application No. 2008-293791, filed on Nov. 17, 2008, the entire contents of which are incorporated herein by reference.

BACKGROUND OF THE INVENTION

1. Field of the Invention

This invention relates to improving the rebound characteristics of a bat for baseball or softball.

2. Description of the Related Art

Conventionally, the flying distance of a ball is thought to be extended when hit by a high strength bat. This is because it was considered that a bat with a high degree of strength has excellent rebound characteristics and the flying distance of a ball depended solely on these rebound characteristics of the bat. However, in recent years, it is understood that the flight distance of a ball which does not rely on the strength of the bat but on a bat which can reduce the consumption of impact energy as ball transformation energy when a ball and bat collide and can extend the flying distance of a ball. In addition, it is understood that the higher the rebound force of the bat itself, the further the flying distance of a ball is extended.

Thus, in order to extend the flying distance of a ball, a variety of bat structures were tried. As a first structure, as shown in Japanese Laid Open Patent 2005-305146, a method was attempted in which a number of urethane layers were arranged on the exterior of a part to be hit of a metal bat and the urethane layers reduced the consumption of impact energy as ball transformation energy. As a second structure, as is shown in 2008-29620, a method was attempted in which a double layered metal bat was formed and the consumption of impact energy as ball transformation energy was reduced by bending of the metal thin tube.

However, in the method in which urethane layers are arranged on the exterior of the part to be hit of a metal bat, because a urethane layer deteriorates by secular distortion, the durability of the bat is inferior compared to a metal manufactured bat. In addition, the bat also suffered from an increase in miss hits.

However, while a metal bat with a double layered structure has no durability problems and the flight distance of a ball is extended, it is difficult to make a light metal bat. Particularly, in the case of a child's or girl's bat, it is impossible to swing the bat unless it is light since they are weak. Generally, swing speed is largely proportional to the weight of a bat and the lighter the bat the faster the swing speed. Therefore, in the case of a child's or girl's bat, lightness is particularly demanded and further improvements in a double layered bat are also demanded. In particular, requests for lightness are predominant for female softball bats.

The present invention can reduce the consumption of impact energy as ball transformation energy and in particular aims to provide a light bat for baseball or softball. Furthermore, the present invention is easy to manufacture and aims to provide a low cost bat for baseball or softball.

BRIEF SUMMARY OF THE INVENTION

A bat for baseball or softball related to one embodiment of the present invention includes, a first tube formed from FRP or synthetic resin having a grip part, a taper part, a part to be hit, a tip part, and a stopper part formed by gradually opening the first tube from the part to be hit side towards the tip part side, and a hollow for latching having a groove shape formed by reducing the diameter of the first tube, a cylindrical second tube having two ends which are open, and having an interior diameter which is larger than an exterior diameter of the part to be hit and smaller than an exterior diameter of the stopper part, the second tube including at least two or more layers, a first fixing component having a donut shape and including a body part and a flange part, the flange part having a larger exterior diameter than an exterior diameter of the body part, and the first fixing component having an opening larger than an exterior diameter of the part to be hit, and an interior periphery surface of the body part being fixed to the first tube and one surface of the flange part being fixed to the stopper part, a second fixing component having a donut shape and including a base part and an insertion part, the insertion part having a smaller exterior diameter than the largest exterior diameter of the base part, and also including a protrusion part which protrudes inwards and an opening which is larger than an exterior diameter of the part to be hit, the protrusion part being fixed by interlocking with the hollow for latching, and a gap located between the first tube and the second tube and being formed by the second tube being attached to an exterior periphery of the first tube, one end of the second tube being fixed to an exterior periphery surface of the body part, and the other end of the second tube being fixed to the insertion part which is inserted between the first tube and the second tube.

A bat for baseball or softball related to another embodiment of the present invention includes, a first tube formed from FRP or synthetic resin having a grip part, a taper part, a part to be hit, a tip part, and a stopper part formed by gradually opening the first tube from the part to be hit side towards the tip part side, and a hollow for latching having a groove shape formed by reducing the diameter of the first tube, a cylindrical second tube having two ends which are open, and having an interior diameter which is larger than an exterior diameter of the part to be hit and smaller than an exterior diameter of the stopper part, the second tube including at least two or more layers, a cylindrical third tube having two ends which are open and having a larger exterior diameter than an exterior diameter of the first tube and a smaller exterior diameter than an exterior diameter of the second tube, a first fixing component having a donut shape and including a body part and a flange part, the flange part having a larger exterior diameter than an exterior diameter of the body part, and the first fixing component having an second body part which has a smaller exterior diameter than an exterior diameter of the body part and being formed so that it protrudes in an opposite direction of the flange part from the body part, and an opening larger than an exterior diameter of the part to be hit, a second fixing component having a donut shape and including a base part and a first insertion part, the first insertion part having a smaller exterior diameter than the largest exterior diameter of the base part, and also including a protrusion part which protrudes inwards, and a second insertion part having a smaller exterior diameter than the exterior diameter of the first insertion part and being formed so that it protrudes in an opposite direction of the base part from the first insertion part, and an opening which is larger than an exterior diameter of the part to be hit, the protrusion part being fixed by interlocking with the hollow for latching, a first gap located between the first tube and the third tube and being formed by the third tube being attached to an exterior periphery of the first tube, one end of the third tube being fixed to an exterior periphery surface of the second body part, and the other end of the third tube is being fixed to the second insertion part which is inserted between the first tube and the third tube, and a second gap located between the third tube and the second tube and being formed by the second tube being attached to an exterior periphery of the third tube, one end of the second tube being fixed to an exterior periphery surface of the body part, and the other end of the second tube being fixed to the first insertion part which is inserted between the third tube and the second tube.

The bat for baseball or softball according to this invention, wherein the second tube may be formed as one body from an inner layer formed from metal or FRP, and at least one or more outer layers formed from either of metal, FRP or wood and may be attached to an exterior periphery of the inner layer.

The bat for baseball or softball according to this invention, wherein the outer layer of the second tube may be formed from a combination of a first part formed from metal and one or more second parts formed from either of metal which is different the metal, FRP or wood, and at least one of the first part and the one or more second parts may be formed from a different material to the other part.

The bat for baseball or softball according to this invention, may further include a cap, the cap including a cap tip part, a cap recessed part and a cap fixing part, the tip part including a curled part in which a tip of the tip part curves inwards, and an exterior diameter of the cap fixing part being smaller than an interior diameter of the first tube from the curled part as far as the stopper part, and an exterior diameter of the cap recessed part being smaller than an interior diameter of the curled part, and the cap recessed part being latched by the curled part.

The bat for baseball or softball according to this invention, wherein a tip of the tip part may curve inwards and may be closed.

The bat for baseball or softball according to this invention, wherein the first tube may further include a step part having an exterior diameter which is smaller than an exterior diameter of the stopper part and larger than an exterior diameter of the part to be hit, and a gap located between the first tube and the second tube and being formed by the second tube being attached to an exterior periphery of the first tube, one end of the second tube being fixed to the step part and the other end of the second tube being fixed to the insertion part which is inserted between the first tube and the second tube.

The bat for baseball or softball according to this invention, wherein the first tube may include a grip part, a taper part, a part to be bit, a tip part and a stopper part formed by opening of the first tube towards the tip part side from the part to be hit side, and the second fixing component may include a base part and an insertion part which has a smaller exterior diameter than a largest diameter of the base part, the second fixing component being fixed to an exterior periphery of the first tube via an adhesive, and a gap located between the first tube and the second tube and being formed by the second tube being attached to an exterior periphery of the first tube, one end of the second tube being fixed to an exterior periphery surface of the body part, and the other end of the second tube being fixed to the insertion part which is inserted between the first tube and the second tube.

The bat for baseball or softball according to this invention, wherein the first tube may be formed from either C-FRP, B-FRP, K-FRP or synthetic resin and an inner layer of the second tube may be formed from either aluminum, an aluminum alloy, titanium, a titanium alloy, a magnesium alloy, an aluminum-scandium alloy, a scandium alloy, a steel alloy or FRP, and an outer layer of the second tube may be formed from either aluminum, an aluminum alloy, titanium, an titanium alloy, a magnesium alloy, an aluminum-scandium alloy, a scandium alloy, a steel alloy, FRP or wood.

The bat for baseball or softball according to this invention, wherein the stopper part may be formed in a position of the part to be hit side at least 100 mm or more from a tip of the tip part, and the second tube may be arranged in the best position for an impact.

The bat for baseball or softball according to this invention, may further comprise a grip end, the grip end being either fixed to the first tube by a screw or an adhesive, or being formed as one body with the first tube.

The bat for baseball or softball according to this invention, wherein the second fixing component may include a first screw part in which an interior of the opening undergoes a thread process, and the first tube may include a second screw part in which a predetermined place on an exterior periphery of the first tube undergoes a thread process, and the second fixing component may be attached to an exterior periphery of the first tube, the first screw part and the second screw part may be fixed by a screw and adhesive.

BRIEF DESCRIPTION OF THE DRAWINGS

FIG. 4 is a diagram which shows a material used for an inner layer and outer layer of a second tube of a bat for baseball or softball related to embodiment one of the present invention.

DETAILED DESCRIPTION OF THE INVENTION

[Structure of a Double Layered Bat]

The bat for baseball or softball related to embodiment one of the present invention will be explained below based on the diagrams. Furthermore, the same structural components have the same symbols and thus an explanation of these components which overlap between embodiments will be omitted. In addition, due to the diagrams, with regards to the material of one part, for example, the overall length of the second fixing component 40 is sometimes displayed longer than in actuality. The proportions related to length for example in a longitudinal direction of each element is not limited to the diagrams.

Figure 1A:
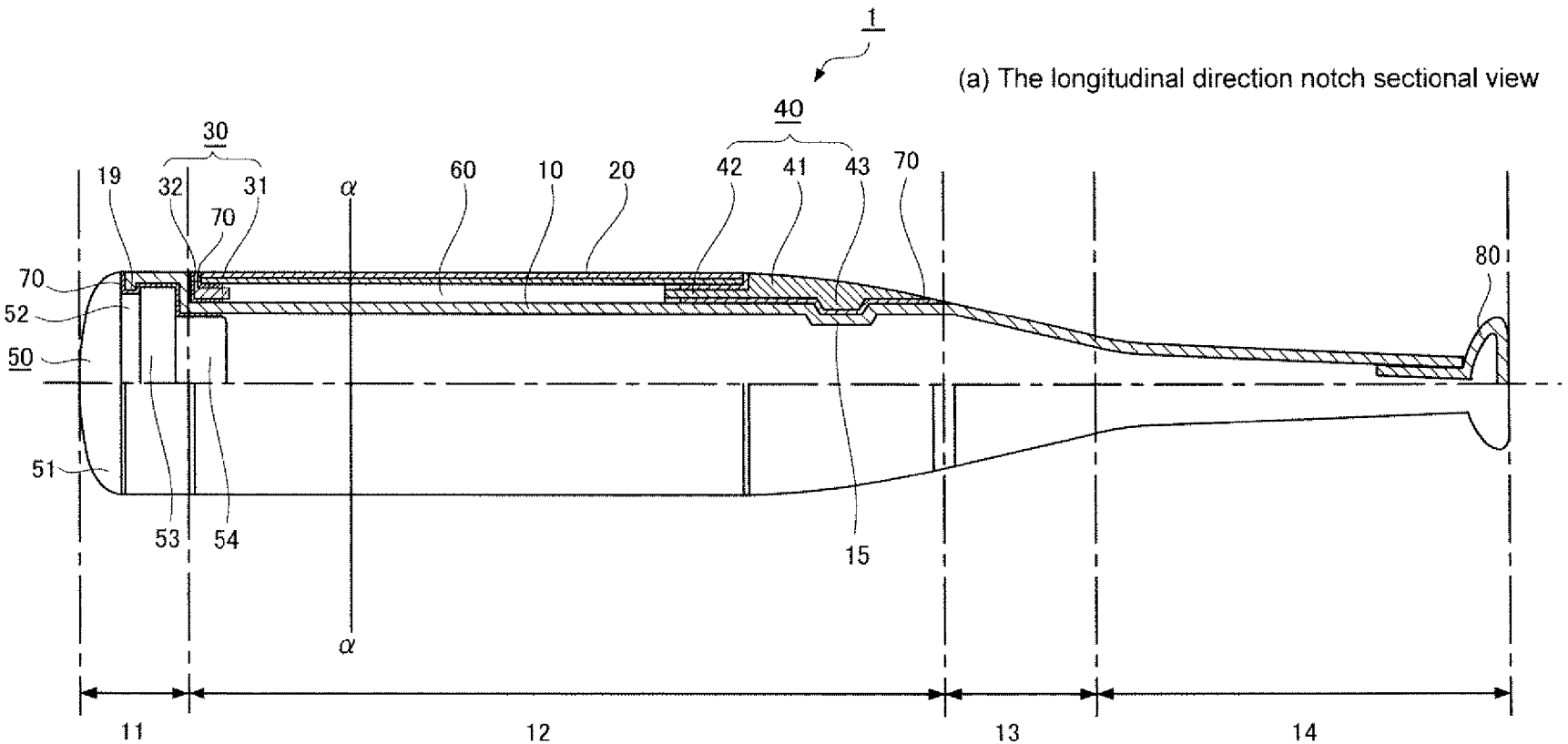
FIG. 1A is a longitudinal direction notch sectional view of a bat for baseball or softball related to embodiment one of the present invention.
Figure 1B:
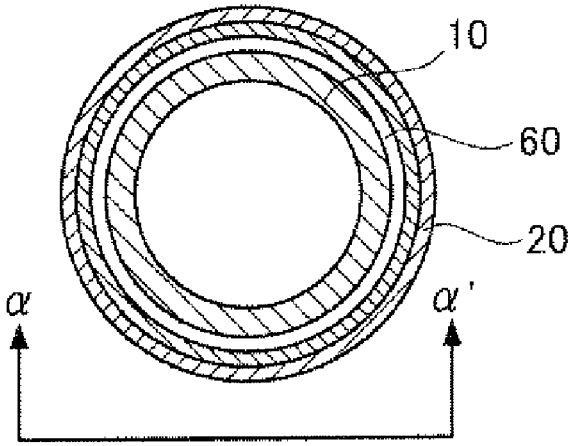
FIG. 1B is a cross sectional view of the line α-α' in a width direction of a bat for baseball or softball related to embodiment one of the present invention.
Figure 2:
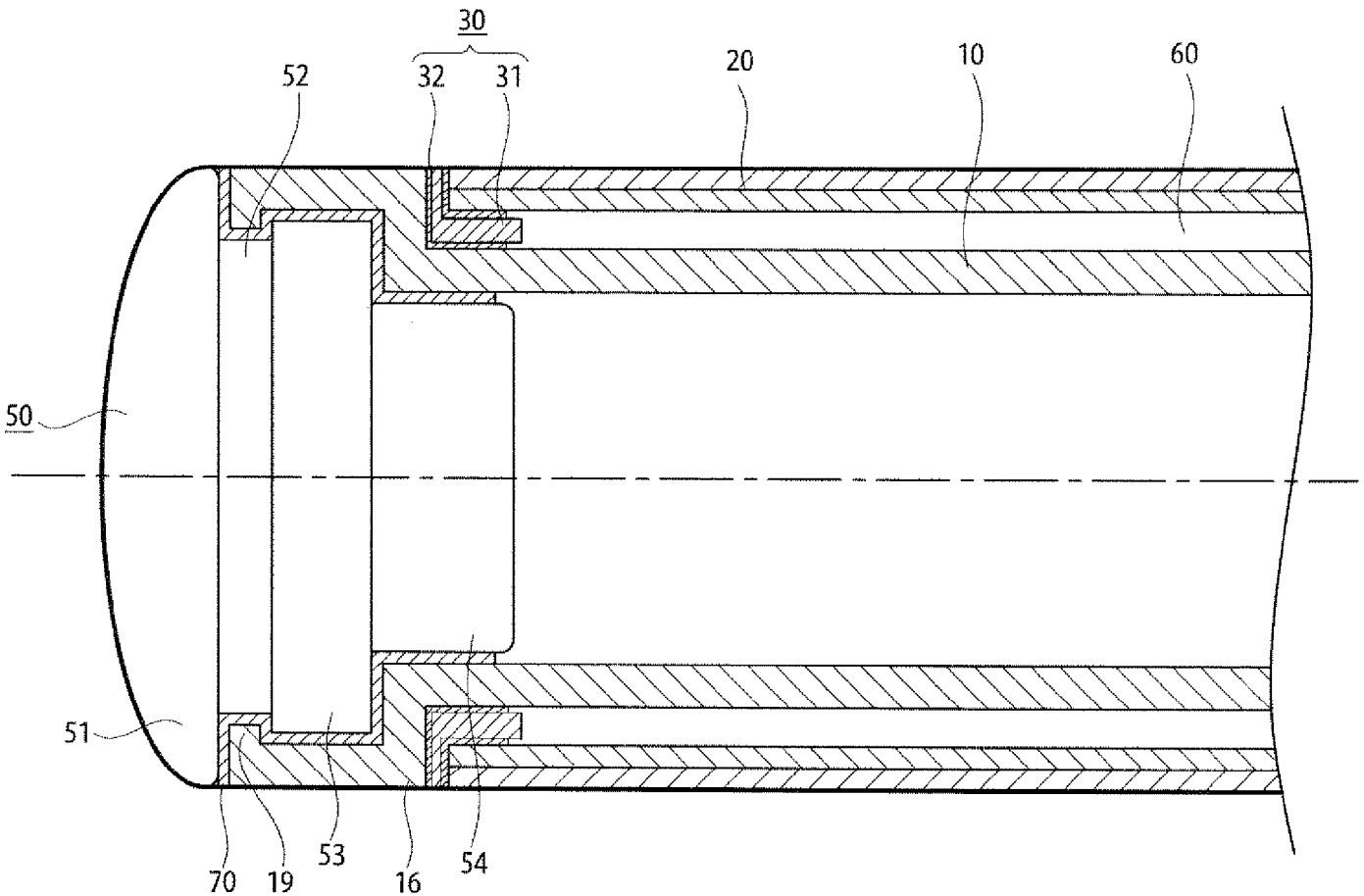
FIG. 2 is an enlarged cross sectional view in a longitudinal direction of a bat tip part and a part to be hit of a bat for baseball or softball related to embodiment one of the present invention.
Figure 3:
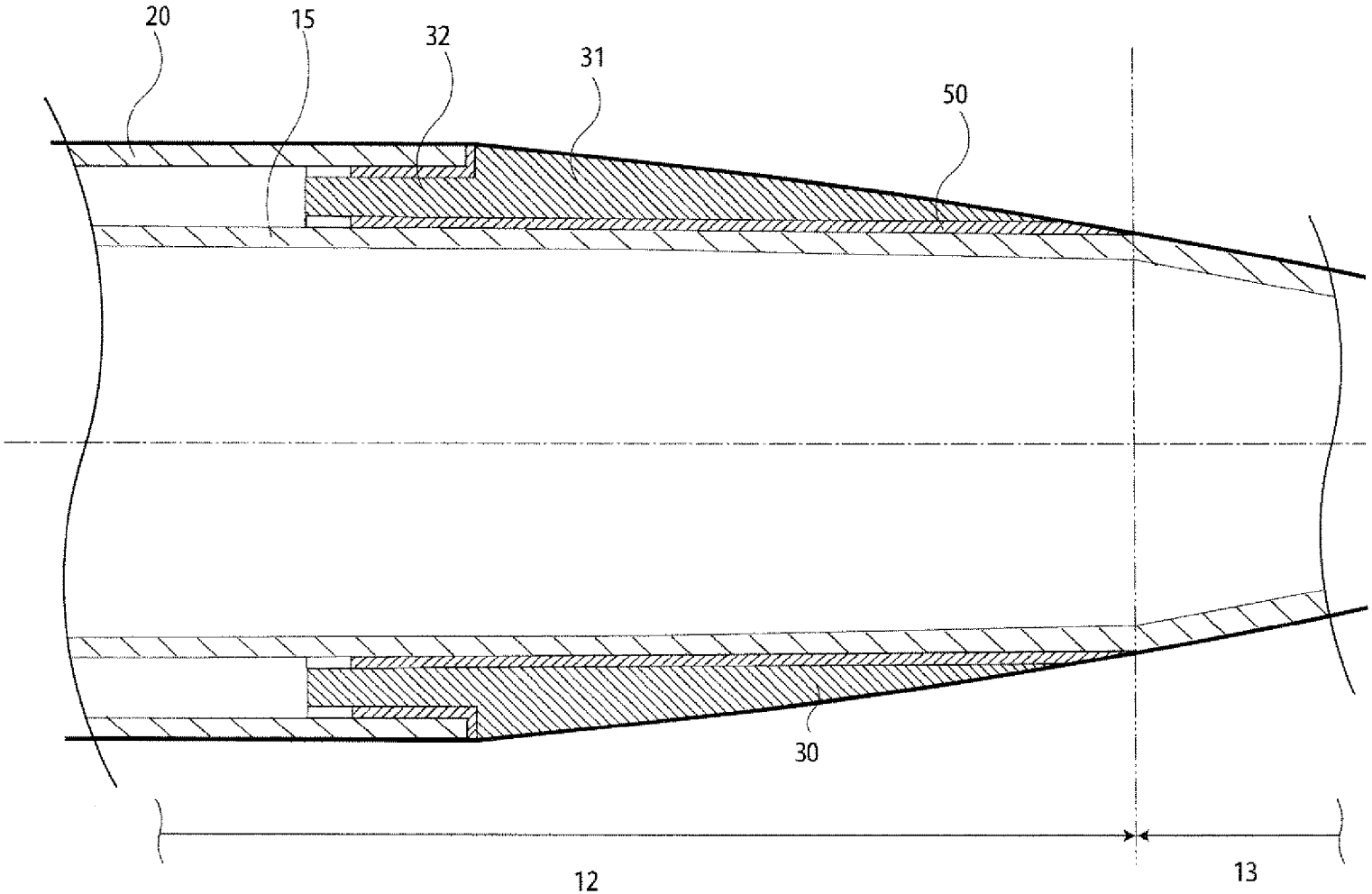
FIG. 3 is an enlarged cross sectional view in a longitudinal direction of a part to be hit and a taper part of a bat for baseball or softball related to embodiment one of the present invention.

FIG. 1A is a longitudinal direction notch sectional view of a bat 1 for baseball or softball related to embodiment one of the present invention. FIG. 1B is a cross sectional view of the line $\alpha$-$\alpha'$ in a width direction of a bat 1 for baseball or softball related to embodiment one of the present invention. In addition, FIG. 2 is an enlarged cross sectional view in a longitudinal direction of a bat tip part 11 and a part to be hit 12 of a bat 1 for baseball or softball related to embodiment one of the present invention. In addition, FIG. 3 is an enlarged cross sectional view in a longitudinal direction of a part to be hit 12 and a taper part 13 of a bat 1 for baseball or softball related to embodiment one of the present invention. Furthermore, one example of a bat for baseball or softball of the present invention is shown in the embodiments below. However, the bat 1 for baseball or softball of the present invention is not limited to these embodiments.

In FIG. 1A, the bat 1 for baseball or softball related to embodiment one of the present invention is roughly comprised of a first tube 10 including a tip part 11, a part to be hit 12, a taper part 13 and a grip part 14, a second tube 20 which is fixed to the exterior of the part to be hit 12 of the first tube 10, a first fixing component 30, a second fixing component 40, a cap 50 and a grip end 80. Furthermore, in embodiment one of the present invention, the second tube 20 is sometimes called an exterior tube 20. In addition, in the bat 1 for baseball or softball related to embodiment one of the present invention, the part to be hit which hits a ball is formed as one part comprising the part to be hit 12 of the first tube 10 and one part of the second tube 20 located on the exterior of the part to be hit 12, however, for the purposes of explanation, only this part of the first tube 10 is called the part to be hit 12 below.

In FIG. 1A, the first tube 10 is the part which forms the center when a ball is hit by a batter. The batter holds the grip part 14, swings the bat 1 and hits a ball which is thrown. As stated above, the first tube 10 is comprised of roughly four component parts, and the bat 1 for baseball or softball related to embodiment one of the present invention is formed as one body from Fiber Reinforced Plastics (herein referred to as FRP) or a synthetic resin in order to secure lightness and strength in particular. Preferably, as a material of the first tube 10, Carbon Fiber Reinforced Plastics (herein referred to as C-FRP), Boron Fiber Reinforced Plastics (herein referred to as B-FRP), and Kevlar (registered trademark) Fiber Reinforced Plastics (herein referred to as K-FRP) may be used. Furthermore, there is foam molding or non-foam molding as a method of forming the first tube 10 with a synthetic resin, and the first tube 10 of the bat 1 for baseball or softball related to embodiment one of the present invention may be formed by either method.

In embodiment one of the present invention, in order to achieve lightness across an entire bat having a double layered structure, the first tube 10 is formed with a thickness of 1 mm-6 mm for example. Furthermore, the above stated thickness is only an example and not limited to this. Then, a screw is cut into interior of the grip part 14 of the first tube 10 and the grip end 80 which is mainly formed from metal is attached by screwing. The grip end 80 is fixed by either screwing, an adhesive or by screwing and adhesive. However, it is not limited to this, the bat grip part 14 and the grip end 80 may be formed as one body. In addition, the material of the grip end 80 is not limited to metal.

Characteristically, the exterior diameter of the bat tip part 11 of the first tube 10 of the bat 1 for baseball or softball related to the first embodiment of this invention, is set larger than the exterior diameter of the bat part to be hit 12. In other words, the first tube 10 is formed so that its diameter increases from the part to be hit 12 to the bat tip part 11. Then, the exterior diameter of this part in which the diameter increases is set larger than the interior diameter of the second tube 20 and preferably is set the same as the exterior diameter of the second tube 20. This increased diameter part is called stopper part 16 and prevents the second tube 20 falling off from the bad tip part 11. Furthermore, the exterior diameter of the stopper part 16 is set the same as the exterior diameter of the second tube 20 so that the exterior surface of the stopper part 16 and the exterior surface of the second tube 20 are formed as one surface.

Furthermore, the bat 1 for baseball or softball related to embodiment one of the present invention is formed so that the tip of the bat tip part 11 curves inwards at a certain length. In other words, the tip of the tip part 11 is almost bent in a perpendicular direction towards the interior of the bat. Below, this part is called curled part 19 and this bending process is called a curl process. The curled part 19 plays the role of latching a cap 50. Therefore, the certain length should be a length sufficient to latch the cap 50 which is processed by press fit processing, and generally is 3 mm-10 mm or more preferably about 5 mm.

In addition, the bat 1 for baseball or softball related to embodiment one of this invention includes a groove which is formed so that it depresses inwards at a place near the border between the part to be hit 12 and the taper part 13. In other words, the bat related to the present invention is processed by reducing the diameter in a certain place on the taper part 13 side of the bat part to be hit 12. This part is called the hollow for latching 15 below. Furthermore, the location where the hollow for latching 15 is formed is not limited to this certain place. The hollow for latching 15 is a part in which a protrusion part 43 of the second fixing component 40 interlocks and plays the role of fixing the second fixing component 40 to the first tube 10. The hollow for latching 15 is formed in a circular shape on the periphery of the first tube 10, however it is not limited to this, it may also be formed only in a specific circular place.

The first tube 10 is formed by FRP or a synthetic resin as stated above. Because the method of forming the first tube 10 by a synthetic resin is a general forming method an explanation is omitted here. However, in a manufacturing method of a bat by FRP, there is a Filament Winding method, a Sheet Winding method and a press manufacturing method, however, the bat 1 for baseball or softball related to embodiment one of the present invention is preferably formed by an internal pressure manufacturing method in which a FRP cylinder formed by a Braiding method (a method which weaves fiber of a fiber reinforced plastic according to a braiding technology) is used. This is for including places in which for example, the diameter of the grip part 14 is small or in places where the diameter of the taper part 13 which gradually increases is not uniform. That is, in the case of forming a bat using FRP by a Sheet Winding method, the bat is formed by winding an FRP sheet on a mandrel which is formed in the shape of a bat and has the above stated places in which the diameter is not uniform. However, even if a sheet which is cut into small pieces is used, it is not easy to evenly wind an FRP sheet on the places in which the diameter is not uniform.

However, while an explanation of the details of the formation method of an FRP cylinder by a Braiding method is omitted, the FRP cylinder (below, this is called an FRP prepreg) which is formed has a triaxial structure in which the FRP which is formed in a filament shape, is formed into cylinder having a woven net shape in three directions. That is, while one FRP fiber continues in a longitudinal direction from the tip to the butt, the other two FRP fibers are woven so that they each intersect at certain fiber orientation angles (this is called in-plane weaving angle). Therefore, an FRP prepreg with uniform strength in a circumference direction can be formed and it is possible to easily design a rigidity distribution by an adjustment of the in-plane weaving angle. Then, because the FRP prepreg which is formed is retractable in the direction of three dimensions, it is possible to easily wind the FRP prepreg on places where the diameter of the mandrel formed in the shape of the bat is not uniform. For the above reasons, when manufacturing the bat 1 for baseball or softball related to embodiment one of the present invention, an FRP prepreg formed by a braiding method can be used preferably.

Next, a manufacturing method of a bat which uses an FRP prepreg formed by the above stated braiding method will be explained. The bat 1 for baseball or softball related to embodiment one of the present invention as stated above, is manufactured by an internal pressure method. However, it is not limited to this. The bat 1 may be also be manufactured by other formation methods.

Specifically, first, an FRP prepreg formed by a braiding method is cut to predetermined dimensions to match the dimensions of a first tube 10.

Next, the FRP which is cut is attached so that it covers a mandrel which is formed almost equal to the interior diameter of the first tube 10, The mandrel is removed and in order to apply internal pressure a nylon tube is passed through the FRP prepreg. In the case where the tip part of the first tube 10 is formed as one body, the tip part is created by an FRP prepreg as a cap according to necessity.

The FRP prepreg with the nylon tube running through it is set in a metal mold. In the case where a grip end 80 is formed on one body, a rounded FRP prepreg is packed into the metal mold in places equivalent to the grip end, however, it is not limited to this. A protrusion part or recession part formed at predetermined places to match the shape of the stopper part 16 which has an enlarged diameter or hollow for latching 15 which has a reduced diameter may be formed in the metal mold.

The prepreg set with the nylon tube running through it is put into a press and it heated while applying internal pressure. Next, the prepreg is removed, the internal pressure tube is taken out and after-cure is performed if necessary. Here, after-cure means a process which hastens the progress of heating and hardening in the post process in the case where hardening at the time of formation is not sufficiently complete.

In order to make the interior solid with foam, foam beads are filled from a hole in the grip end and further heated. The above manufacturing process is the manufacturing process of the first tube 10 of the bat 1 for baseball or softball related to embodiment one of the present invention which uses an FRP prepreg formed by a braiding method.

A second tube 20 of the bat 1 for baseball or softball related to embodiment one of the present invention is a cylindrical tube in which both ends are open and have a uniform exterior diameter. The interior diameter of the second tube 20 is larger than the exterior diameter of the bat part to be hit 12 and preferably is a diameter about twice the height of a gap 60 formed between the first tube 10 and second tube 20 larger than the exterior diameter of the first tube 10.

Characteristically, the second tube 20 uses multi-layer structure which includes an inner layer and an outer layer. In the present embodiment, a tube having a composite two layer structure is used as the second tube 20, however, it is not limited to this, for example, a tube having a composite three layer structure may also be used. For the purposes of explanation, in the embodiments and examples below, an example will be explained which uses the second tube 20 having a composite two layer structure Here a composite two layer structure is a tube having a two layer structure including an inner layer and an outer layer (a surface layer in the case of a two layer structure) attached to the periphery of the inner layer and formed from a different material to the inner layer. Details regarding the materials the inner layer and outer layer are shown in FIG. 4. As is shown in FIG. 4, aluminum, aluminum alloy, titanium, titanium alloy, magnesium alloy, aluminum-scandium alloy, scandium alloy, steel alloy or any FRP may be used as a material for the inner layer. However, as shown in FIG. 4, aluminum, aluminum alloy, titanium, titanium alloy, magnesium alloy, aluminum-scandium alloy, scandium alloy, steel alloy, FRP or any wood material may be used. Here, wood material in the present specification refers to a wood material formed in the shape of a thin sheet and attached by winding at a predetermined diameter to form a cylinder shape, or a wood material formed in the shape of a cylinder in which the interior is hollowed out. However, it is not limited to this. A tube formed using a wood material is generically named. In the bat related to the present embodiment, aluminum, aluminum alloy, aluminum-scandium alloy, scandium alloy and FRP may be preferably used as the material of the inner layer. In addition, titanium, titanium alloy, magnesium alloy and FRP which are light and have excellent rebound characteristics can be preferably used as the material of the outer layer, and a wood material from which a batter receives a good feeling when hitting a ball, can be preferably used. In the present embodiment, aluminum or aluminum alloy is used as the material of the inner layer and titanium or titanium alloy having excellent rebound characteristics is used as the material of the outer layer. The inner layer and outer layer are formed separately and normally the inner layer is pressed into place in the outer layer, however, the exterior surface of the inner layer may be applied with an adhesive or resin and attached by inserting within the outer layer. In addition, the layers may be formed by other methods. In the case where a metal is used as the material of the inner layer and outer layer, the metal is used once the inner layer and outer layer have been heat treated. In a general double layered metal bat, particularly when the material of the exterior tube and interior tube are different, due to the difference in the rate of thermal expansion of each tube, a heat process for releasing stress is extremely difficult. However, the materials of the inner layer and outer layer of the bat related to the present embodiment are different, and because each layer is formed separately and formed as one body by press fit processing for example, a heat process of a metal tube is easier compared with a general double layered metal bat.

Furthermore, because an inner layer and outer layer are used in as a composite, even if each tube is formed thinly it is possible to secure strength. Therefore, in the present embodiment, the thickness of each tube is formed about half as thick as the thickness of the second tube of the bat shown in Japanese Laid Open Patent 2008-29620 and in the case where the tubes are attached together using press fit processing so that no gap remains between the tubes, the total thickness is almost the same as this second tube However, it is not limited to this. The thickness of each tube may be determined according to the demanded strength and the thickness of the inner layer and outer layer may be different. In whichever case, it is possible to achieve lightness while securing strength across the entire second tube 20 by this composite multi-layer structure.

Although not shown in the diagrams, a make-up sheet can be applied to the exterior of the above stated second tube 20 for the purpose of protecting the second tube 20 from damage and for design effect. This make-up sheet can be formed from, for example, a resin film such as a polyethylene film, an elastomer film and a plastic film or an FRP sheet.

As is shown in FIG. 2, a first fixing component 30 has a donut shape in the form of an opening and is a component for fixing one end of the second tube 20 to the tip end part 12 of the first tube 10. The first fixing component 30 includes first fixing component body part 31 and a first fixing component flange part 32. The diameter of the opening is set slightly larger than the exterior diameter of the bat part to be hit 12 of the first tube 10.

The body part 31 of the first fixing component 30 has a certain height. This height is the height when the gap 60 having a certain height is formed between the first tube 10 and the second tube 20 in the case where the first fixing component 30 is attached to the first tube 10 via an adhesive 70 and the second tube 20 is fixed to the periphery of the body part 31 by the adhesive 70. In other words, this height is set at a height after the height of the intervening hardened adhesive 70 is subtracted from the certain height of the formed gap 60. Furthermore, this body part 31 plays a role equivalent to the fulcrum of a spring when the second tube 20 bends when a ball is hit.

However, the flange part 32 of the first fixing component 30 plays the role of preventing damage by contact of the end part of the second tube 20 contacting the stopper part 16 of first tube 10 or for preventing the generation of a metal sound. The exterior diameter of the flange part 32 is set the same as the exterior diameter of the stopper part 16 and the second tube 20. The exterior surface of each of the stopper part 16, the flange part 32 and the second tube 20 is for making the same flat surface.

As is shown in FIG. 3, the second fixing component 40 has an opening and has a roughly conic shape where the upper part was severed. The second fixing component 40 is a component for fixing the other end of the second tube 20 to the taper part 13 side of the bat part to be hit 12 of the first tube 10. The second fixing component 40 includes a second fixing component based part 41, a second fixing component insertion part 42 and a second fixing component protrusion part 43. The diameter of the opening of the second fixing component 40 is the same as the diameter of the opening of the first fixing component 30 and is set slightly larger than the exterior diameter of the bat part to be hit 12 of the first tube 10.

The exterior diameter of the base part 41 of the second fixing component 40 is set so that it steps down in one direction and in the case where the second fixing component 40 is fixed to the first tube 10, the periphery of the base part 41 connects smoothly with the exterior periphery of the taper part 13 of the first tube 10 and forms one exterior surface. In addition, the largest exterior diameter of the base part 41 is set the same as the exterior diameter as the second tube 20 and the exterior surface of the second tube 20 and the exterior surface of the base part 41 are formed as one exterior surface.

The insertion part 42 of the second fixing component 40 is inserted between the first tube 10 and the second tube 20 and has a certain height. This height is generally the same height as the height of the body part 31 of the first fixing component 30. Therefore, in the case where the first tube 10 and the second tube 20 are fixed via the adhesive 70 and insertion part 42, a gap 60 with a certain height is formed between the tubes. However, the height of the insertion part 42 is not limited to this and may be different to the height of the body part 31.

Characteristically, the second fixing component 40 includes a protrusion part 43 having a ring shape and arranged so that it protrudes toward the interior of the opening. The cross sectional form of the protrusion part 43 is the same as cross sectional form of the hollow for latching 15 which is formed on the first tube 10 and is a shape which interlocks with the hollow for latching 15. Therefore, in the case where the second fixing component 40 is attached to the first tube 10, by interlocking the protrusion part 43 to the hollow for latching 15 the second fixing component 40 is rigidly fixed to the first tube 10. However, the shape of the protrusion part 43 is not limited to this and may be a shape in which a part of the ring is cut in a plurality of places and may also be any other shape.

In addition, the second fixing component 40 may also include a first screw part (not shown in the diagram) which has undergone a thread cutting process and is arranged within the opening, and in this case, a second screw part (not shown in the diagram) which has undergone a thread cutting process is arranged in certain places on the periphery of the first tube 10. Then, the second fixing component 40 is attached to the exterior periphery of the first tube 10 and the first screw part and second screw part are fixed by a screw stop and adhesive.

The first fixing component 30 and the second fixing component 40 explained above formed from a plastic or synthetic rubber such as polyurethane, polyamide or polyethylene or a different elastomer material. However, the material of the first fixing component 30 and the second fixing component 40 is not limited to this. A synthetic resin, metal or ceramic may also be used for the material of the first fixing component 30 and the second fixing component 40.

In the present embodiment a cap 50 is attached to the tip part 11 of the first tube 10 shown in FIG. 1 by press fit processing. When the bat is being used, it is usually thrown after a ball has been hit. In addition, depending on the user, there are times when the tip of bat hits a spike or is dropped in dirt or mud and also hits the ground. The cap 50 acts to protect the bat in these cases. That is, the cap 50 also acts to protect the bat from damage caused by actions other than hitting a ball.

The cap 50 which fulfills this function is formed by a resin in the present embodiment and is inserted into the tip of the first tube 10 by press fit processing as stated above. However, the material of the cap 50 is not limited to this. The cap 50 will be explained in detail while referring to FIG. 2. As is shown in FIG. 2, the cap 50 is comprised of a cap tip part 51, a cap recessed part 52, a cap fixing part 53 and a cap second fixing part 54. The cap tip part 51 protects the tip part 11 of the first tube 10 after the bat is formed.

The cap recessed part 52 plays the role of fixing the cap 50 to the tip part 11 of the first tube 10 in the case where the cap 50 is inserted into the tip part 11 of the first tube 10 by press fit processing. Here, the exterior diameter of the cap recessed part 52 is smaller than the interior diameter of a curled part 19 of the tip part 11. Therefore, when the cap 50 is press fitted, because the curled part 19 cuts into the recessed part 52 of the cap 50, the cap 50 fits onto the tip part 11 of the first tube 10.

The cap fixed part 53 has a larger exterior diameter than the interior diameter of the curled part 19. Therefore, when the cap 50 is once inserted into the tip part 11 of the first tube 10 by press fit processing, this cap fixed part 53 is hooked by the curled part 19 and the cap 50 is prevented from jumping out. Furthermore, at the time of press fit processing, the interior of the tip part 11 of the first tube 10 is applied with the adhesive 70, the adhesive hardens between the exterior of the cap fixed part 53 and the interior of the tip part 11 of the first tube 10 and the cap 50 is more rigidly fixed. In the same way the cap second fixed part 54 plays the role of fixing the cap 50 to the tip part 11 of the first tube 10 by the adhesive 70.

Next, the manufacturing process of the bat 1 for baseball or softball related to embodiment one of the present invention using the components stated above will be explained. First, adhesive 70 is applied to the inside of the opening of the first fixing component 30 and one surface of the flange part 32. Next, the first fixing component 30 which is applied with the adhesive 70 is attached to the first tube 10 from the grip end 14 side and is fixed to the tip part 11 side of the part to be hit 12 of the first tube 10 by the adhesive 70. At this time, one surface of the flange part 32 is fixed to the stopper part 16 by the adhesive 70 and the first fixing component is more rigidly fixed.

After the first fixing component 30 is fixed to the first tube 10, the adhesive 70 is applied to the outside of the body part 31 of the first fixing component 30 and the other surface of the flange part 32. By attaching the second tube 20 to the exterior periphery of the first tube 10 from the grip part 14 side so that one end of the second tube 20 is in contact with the flange part 32, the exterior of the body part 31 and the other surface of the flange part 32 are fixed with one end of the second tube 20 by the adhesive 70.

Next, the adhesive 70 is applied to the interior of the opening of the second fixing component 40 and the exterior of the insertion part 42. This second fixing component 40 is attached to the first tube 10 from the grip 14 side and the insertion part 42 is inserted between the first tube 10 and the second tube 20. By inserting the insertion part 42 while applying pressure the protrusion part 43 of the second fixing component 40 is interlocked with the hollow for latching 15 of the first tube 10 and the second fixing component 40 is fixed to the first tube 10 by the adhesive 70. However, the fixing of the second fixing component 40 is not limited to this. A screw may be threaded in advance on the inside of the opening of the second fixing component 40 and the second fixing component 40 is attached to the first tube 10 by screwing. The adhesive and screwing may be used together.

Lastly, a thread is cut into the inside of the grip part 14 of the first tube 10 and the grip end 80 formed separately by metal in advance is attached by screwing. The grip end 80 may be attached by screwing and an adhesive, or another method may also be used.

The bat 1 for baseball or softball related to embodiment one of the present invention is manufactured by the above process. Here, because one end of the second tube 20 is fixed to the body part 31 of the first fixing component 30 and the other end of the second tube 20 is fixed to the insertion part 42 of the second fixing component 40, a gap 60 having a certain height is formed between the first tube 10 and the second tube 20. The second tube 20 bends inwards when a ball is hit, and the gap 60 is a space which plays the role of reducing the consumption of impact energy as ball transformation energy. The height of this gap 60 can be adjusted by a certain height of the body part 31 and the insertion part 42 (in other words, a certain diameter). In the present embodiment, the interval of the gap 60 is set for example between 0.1 mm and 3.0 mm or more preferably between 0.3 mm and 0.5 mm according to the material of the first tube 10 and second tube 20.

(Effects of a Double Layered Bat)

It is possible to reduce the consumption of impact energy as ball transformation energy by the present invention and in particular a light bat for baseball or softball is proposed. In addition, a bat for baseball or softball which is easy to manufacture and low cost is proposed.

The bat 1 for baseball or softball related to embodiment one of the present invention is arranged with a gap 60 having a certain height between the first tube 10 and the second tube 20. Then, the second tube 20 has a composite multi-layer structure and the surface layer of the multi-layers is mainly formed from a metal having superior rebound characteristics than the first tube 10. Therefore, when a ball is hit, mainly the second tube 20 bends inwards, consumption of the impact energy as ball transformation energy is reduced and because the second tube 20 itself has superior rebound characteristics, the flight distance of the ball can be extended. Furthermore, because the second tube 20 has a composite multi-layer structure, it is possible to design the bat 1 related to the present embodiment with low flat bending rigidity and improve rebound characteristics.

Secondly, as stated above, because the first tube 10 of the bat 1 for baseball or softball related to embodiment one of the present invention is formed by FRP or synthetic resin each of which has excellent rigidity and lightness, it is possible to make the entire bat lighter. Therefore, in the case of a child's or girl's bat it is possible to improve a batter's swing speed. Because the bat related to the present embodiment is light, the rebound characteristics of the bat itself due to a double structure having a gap and the flight distance of a ball can be significantly extended. It is possible to finely adjust the weight of the entire bat 1 for baseball or softball related to the present embodiment by appropriately selecting the material of the outer layer and inner layer of the composite multi-layer structured second tube 20. Therefore, even in the case of an adult men's bat it is possible to finely adjust the bat according to the needs of the user and also manufacture an order made bat.

Thirdly, because the bat related to embodiment one is a double layered bat with a first tube 10 comprised from the above stated FRP or synthetic resin, and a second tube 20 having an outer layer and inner layer composite multi-layer structure, vibration effects can be improved and the feeling when a ball is hit can be significantly improved compared to a bat with a single layer structure. The pain felt by a batter when a ball is miss-hit for example, can be reduced by the bat of the present invention. Because the second tube 20 which directly contacts with a ball is externally interlocked with the first tube 10 and because the second tube 20 itself is a composite multi-layer structure in which a plurality of layers are press fitted or stuck together, the effects of vibration control are demonstrated by a shear phenomenon and the vibration of the grip end 14 can be reduced. In addition, the feeling when a ball is hit can be particularly improved in the case where the outer layer of the second tube 20 is formed from a wood material.

Fourthly, the bat for baseball or softball related to the present invention is formed as one body from FRP or synthetic resin up to the bat tip end 11 which gives high rigidity to the bat tip part. For example, the rigidity of the bat is higher than that of the bat cited in Japanese Laid Open Patent 2008-29620. Therefore, even if the ball is hit with the tip end side of this bat, the flight distance of the ball can be extended. Furthermore, as stated above, because the bat is formed from up to the tip end part from FRP or synthetic resin, fifthly, durability of the bat can be improved.

As stated above, because the cap 50 is inserted into the tip part 11 of the first tube 10 by press fit processing, processing becomes easy. Therefore, the sixth effect is that it is possible to reduce the operational processes of the bat 1 for baseball or softball related to embodiment one of this invention. In addition, there is no need to use complex processes in order to interlock the parts and strict processing accuracy of the tip part 11 of the first tube 10 is not demanded. Therefore, it is both possible to reduce the cost of the various parts and therefore the overall manufacturing costs of the bat.

Seventh, safety is improved in the bat 1 for baseball or softball related to embodiment one of this invention. In the bat related to the present invention as stated above, the second tube 20 is latched by the stopper part 16 of the first tube 10. Therefore, the first tube 10 and second tube 20 can be securely latched by adjusting the interior diameter of the second tube 20 and exterior diameter of the first tube 10. As a result, even if the resin cap 50 is damaged, as long as the first tube 10 itself is not damaged the second tube 20 will not come loose and jump out and thus safety is improved.

Eighth, the life cycle of the bat 1 for baseball or softball related to embodiment one of this invention is much longer. The bat for baseball or softball related to embodiment one of this invention has a double layered structure, however, the second tube 20 is attached and fixed via the first fixing component 30 and the second fixing component 40 with the adhesive 70 or because the second fixing component 40 is fixed to the first tube 10 by adhesive 70 or screw and adhesive 70, it is possible to easily replace the second tube 20 alone which can cause damage when a ball is hit. In a conventional bat with a metal, double layered structure, because the exterior tube (or the interior tube) is latched to the body by a swaging process, even when the exterior tube (or the interior tube) is damaged, it could not be replaced. The life cycle of the bat related to the present embodiment can be made much longer by replacing the exterior tube 20. Furthermore, because the second tube 20 of the bat related to the present embodiment has an inner layer and outer layer composite multi-layer structure, the effects of secular distortion are few and durability is excellent compared to a double layer bat having urethane layer.

Example One

Another example of the bat 1 for baseball or softball related to embodiment one of the present invention will be explained. As stated above, the bat 1 for baseball or softball related to embodiment one of the present invention includes a cap 50. However, if the bat tip end can be formed by the entire first tube 10 then rigidity of the tip part 11 can be further increased. The present example is an example where the bat tip is formed by the first tube 10.

Figure 5:
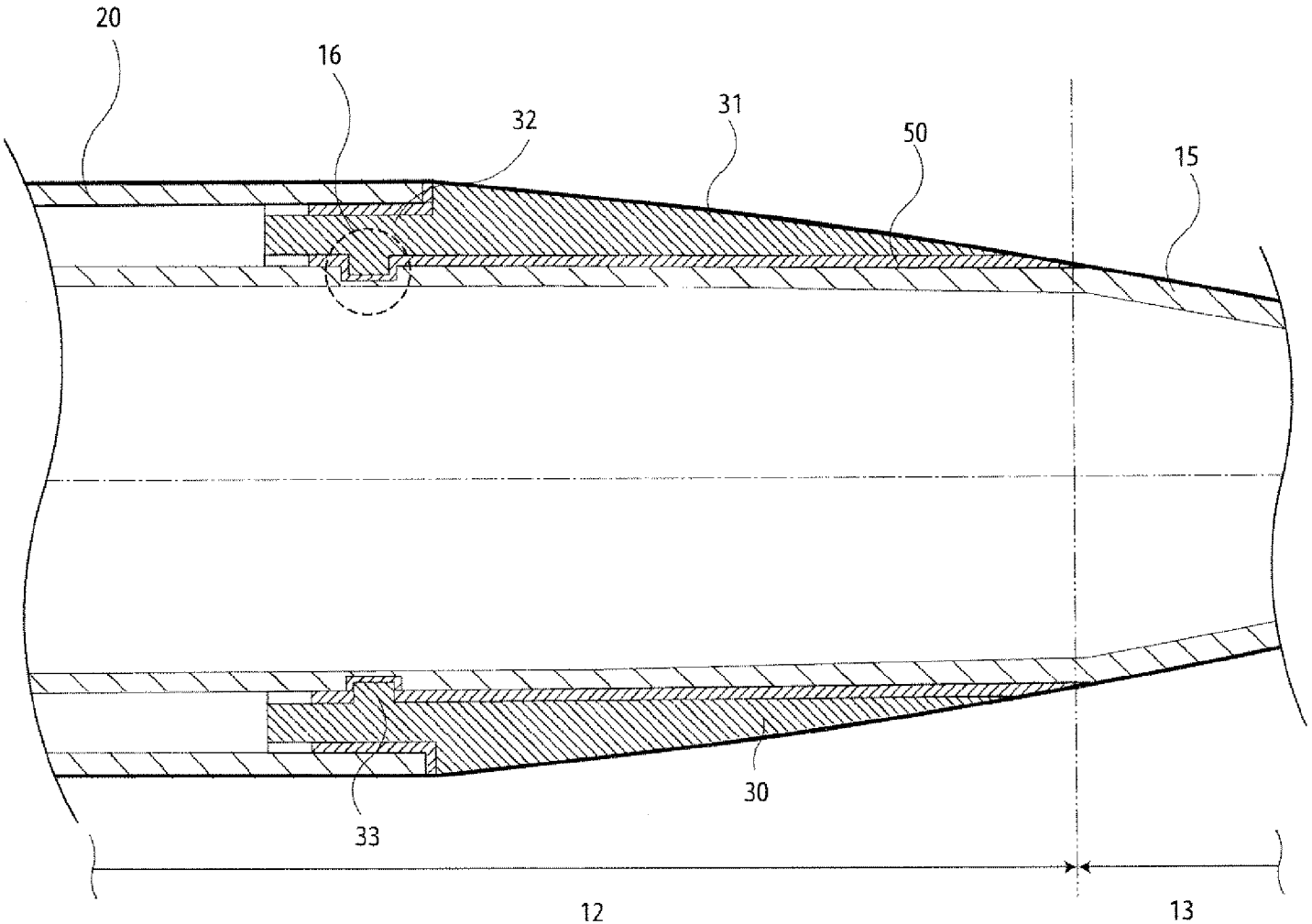
FIG. 5 is an enlarged cross sectional view in a longitudinal direction of a bat tip part of a bat for baseball or softball related to example one of embodiment one of the present invention.

An explanation will be made based on the diagrams. FIG. 5 is an enlarged cross sectional view in a longitudinal direction of a bat tip part 11 of the bat 1 for baseball or softball related to example one of embodiment one of the present invention. As is shown in FIG. 5, in the present example, the first tube 10 includes the stopper part 16 and the gap 60 is formed between the first tube 10 and the second tube 20. This is the same as the bat 1 for baseball or softball related to embodiment one of the present invention stated above.

In the bat 1 of the present example, the bat 1 is formed with the first tube 10 up to the tip of the first tube (that is, bat tip) 15 from the stopper part 16. The formation method of the bat for baseball or softball of the present example, is basically the same as the manufacturing method of the bat for baseball or softball related to the above described embodiment one. The only difference is that in the case where the mandrel is removed and a nylon tube is passed through in order to apply internal pressure, a cap which is created separately by a prepreg is set on the bat tip end. The process of heating while applying internal pressure is the same.

Because the bat 1 for baseball or softball related to the present example having the above described structure is formed as one body from FRP or synthetic resin up to the bat tip part 11, the rigidity of the bat tip part 11 is significantly increased. In addition, because the bat 1 is one body of FRP or synthetic resin formed up to the bat tip part 11, durability is further improved. Furthermore, because a process of pressing the cap into place is omitted, it is possible to reduce operation time. The points including being able to increase the flight distance of a ball by a double layered structure having a gap 60, being able to lighten the entire bat, improve vibration damping effects, reduce hand pain, improve safety, extend the life cycle of the bat and improve durability compared with a hybrid type bat are all the same as in embodiment one.

Second Example

Figure 6:
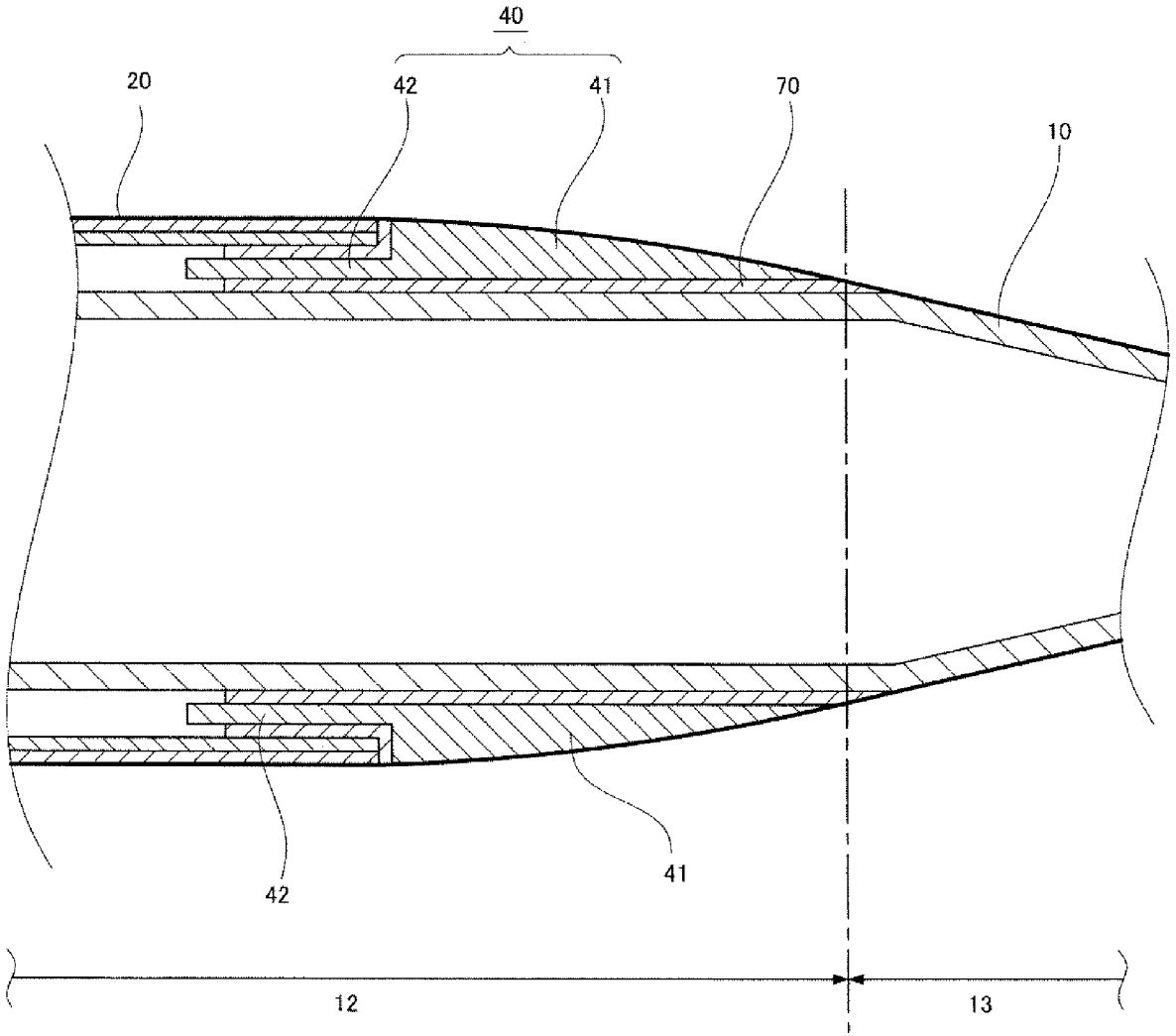
FIG. 6 is an enlarged cross sectional view in a longitudinal direction of a part to be hit and a taper part of a bat for baseball or softball related to example two of embodiment one of the present invention.

Another example of the bat 1 for baseball or softball related to embodiment one of the present invention will be explained. In the bat for baseball or softball related to embodiment one of the present invention, latching of the second tube 20 near the taper part 13 of the first tube 10 takes place by using the second fixing component 40 via the adhesive 70, or via a screw and adhesive 70. The second example of the bat for baseball or softball related to embodiment one of the present invention is an example in which fixing this second fixing component to the first tube 10 is made easier. An explanation is made based on the diagrams. FIG. 6 is an enlarged cross sectional view in a longitudinal direction of a part to be hit 12 and a taper part 13 of the bat 1 for baseball or softball related to example two of embodiment one of the present invention.

As is shown in FIG. 6, the second fixing component 40 related to example two only includes a base part 41 and an insertion part 42. However, the hollow for latching 15 is not formed on the first tube 10. In addition, in the case where the second fixing component 40 is fixed by a screw, a first screw part is arranged within the opening of the second fixing component 40 and a second screw part is arranged on the periphery of the first tube 10 the same as in embodiment one explained above.

Fixing of the second tube 20 of the bat 1 for baseball or softball related to the second example is performed only via the adhesive 70. Generally, because centrifugal force operates when a ball is hit, the force which tries to move the second tube 20 of the double layered bat which formed towards the bat tip part 11 also operates. Therefore, latching in the bat tip part 11 side of the second tube 20 is extremely important.

However, there is not centrifugal force in operation on the grip part 14 side. As a result, latching in the grip part 14 side does not demand as much strength compared to latching in the bat tip end part 11 side. Therefore, latching via the adhesive 70 or latching via a screw and adhesive 70 sufficiently fulfills the demands for latching strength.

In the bat related to the second example, because it is not necessary to form the hollow for latching of the first tube 10 and the protrusion part of the second fixing component 40, it is not necessary to design in detail the positioning for interlocking. In addition, in the case where the second tube 20 is damaged for example, because it is possible to easily remove and exchange the second tube 20 by simply removing the adhesive 70 or by simply removing the second fixing component 40 which is stopped with a screw, maintenance is easy. The points including being able to increase the flight distance of a ball by a double layered structure having a gap 60, being able to lighten the entire bat, improve vibration damping effects, reduce hand pain, improve safety, extend the life cycle of the bat and improve durability compared with a hybrid type bat are all the same as in embodiment one and thus an explanation is omitted.

Furthermore, the second example can be applied to the bat shown in example one. The effects in this case were the same as the effects described above.

Example Three

Figure 7:
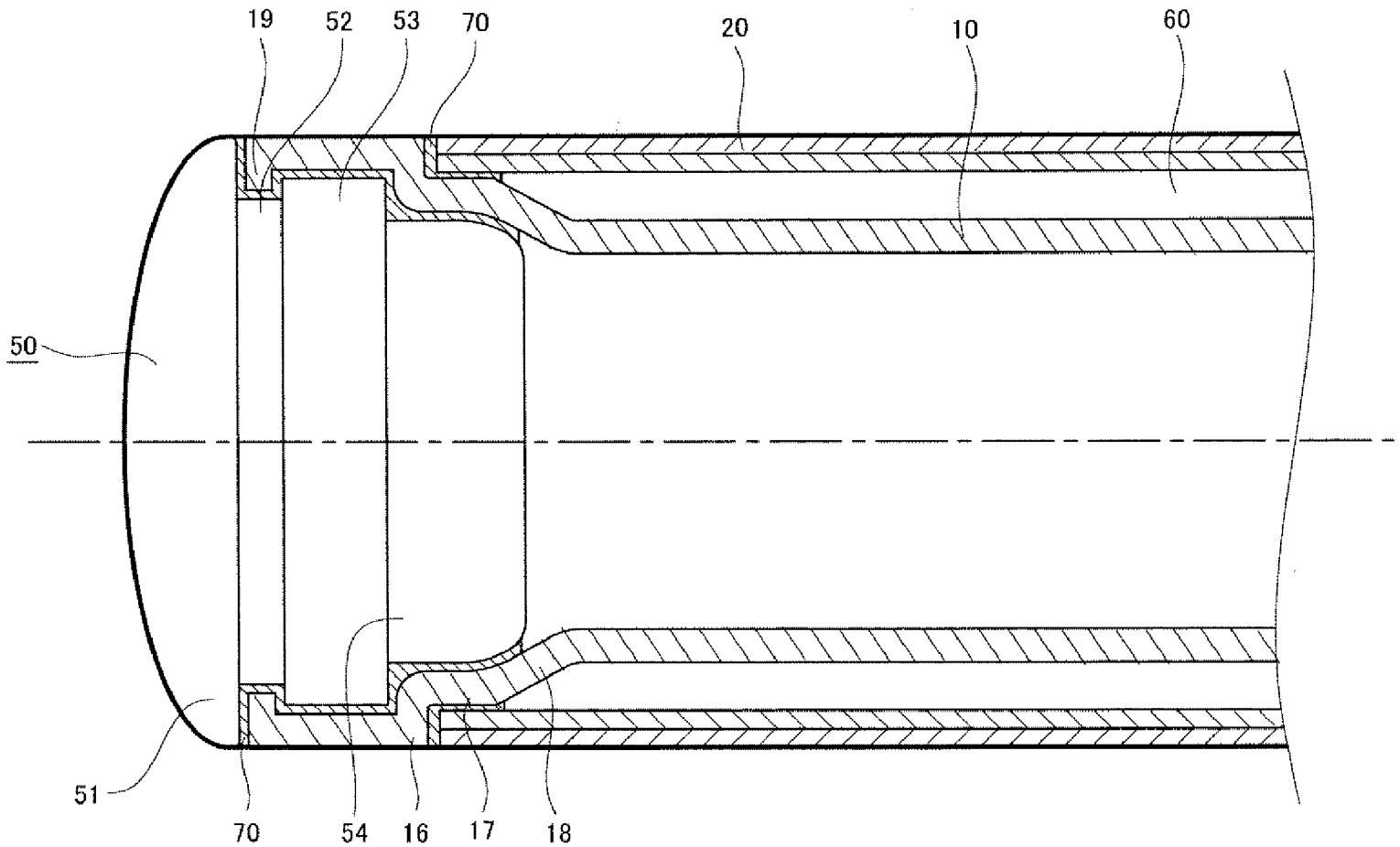
FIG. 7 is an enlarged cross sectional view in a longitudinal direction of a bat tip part of a bat for baseball or softball related to example three of embodiment one of the present invention.
Figure 8:
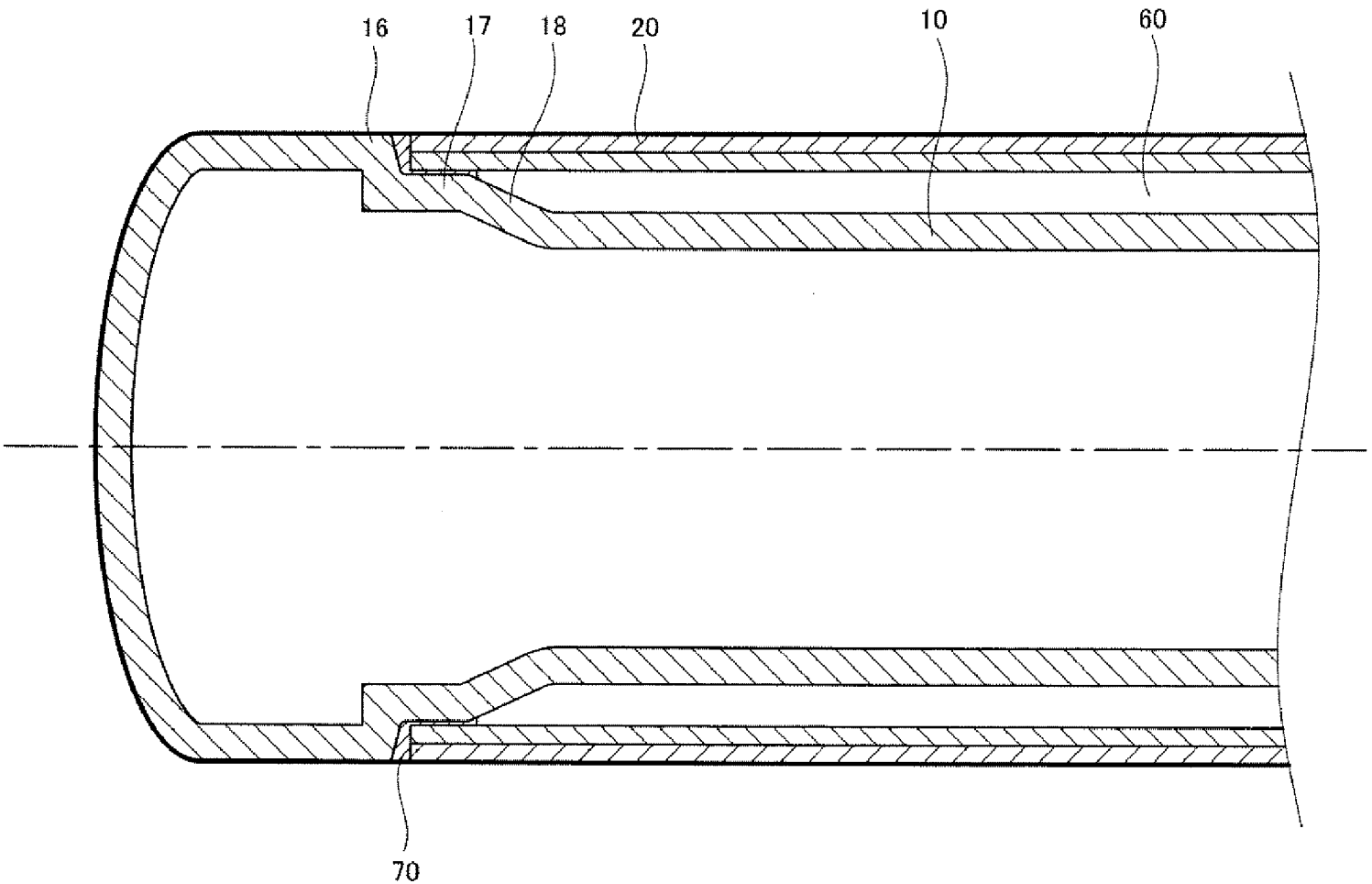
FIG. 8 is an enlarged cross sectional view in a longitudinal direction of a bat tip part of a bat for baseball or softball related to example three of embodiment one of the present invention.

Another example of the bat 1 for baseball or softball related to embodiment one of the present invention will be explained. As stated above, in the bat 1 for baseball or softball related to embodiment one of the present invention, in order to form the gap 60 between the first tube 10 and the second tube 20, the first fixing component 30 and the second fixing component 40 are used. Here, if the diameter of the bat tip end part 11 side of the part to be hit 12 of the first tube 10 is increased by a certain diameter, even if the first fixing component 30 is omitted and only fixed by the adhesive 70, it is possible to form the gap 60 with a certain height. The bat related to example three is an example in which the first fixing component is omitted. An explanation will be made based on the diagrams. FIG. 7 and FIG. 8, are enlarged cross sectional views in a longitudinal direction of the end tip part 11 of the bat 1 for baseball or softball related to example three of embodiment one of the present invention. FIG. 7 shows a bat with the cap 50 and FIG. 8 shows a bat without the cap.

As is shown in FIG. 7, the first tube 10 of the bat of example three to is formed so that the exterior diameter gradually increases towards the tip part 11 from a certain position on the bat tip part 11 side of the part to be hit 12 and extends at a certain diameter which is increased up to the stopper part 16 from a first place which the exterior diameter is increased to a certain diameter. This part which is extended at a certain diameter is called a step part 17. In addition, a place where the exterior diameter between the step part 17 and the part to be hit 12 gradually increases is called a connecting part 18. Furthermore, although a stopper part 16 and a curled part 19 are formed this is the same as example one and example two of embodiment one described above.

Here, the exterior diameter of the step part 17 is set so that the gap 60 is formed to a desired height between the first tube 10 and the second tube 20 in the case where the second tube 20 is fixed to the step part 17 by the adhesive 70. That is, the exterior diameter of the second tube 20 is enlarged so that it is equivalent to the height of the body part 31 of the first fixing component 30 of example one and example two of embodiment one described above. Therefore, the first fixing component 30 which is used in order to form the gap 60 with a desired height is no longer required.

The bat 1 for baseball or softball related to example three having this structure is completed simply by attaching the second tube 20 to the exterior periphery of the first tube 10 after the adhesive 70 is applied to this step part 17 and stopper part 16 in the case where the second tube 20 is fixed to the first tube 10. Therefore, the operation for attaching the first fixing component 30 to the first tube 10 in advance can be omitted and operation time can be reduced. Therefore, manufacturing costs can also be further reduced. In addition, the points including being able to increase the flight distance of a ball by a double layered structure having a gap 60, being able to lighten the entire bat, improve vibration damping effects, reduce hand pain, improve safety, extend the life cycle of the bat and improve durability compared with a hybrid type bat are all the same as in embodiment one and thus an explanation is omitted.

Furthermore, example three can be applied to the bat shown in example one and an example of this is shown in FIG. 8. Because the manufacturing process is the same as that process described above, an explanation is omitted here. In addition, the effects are also the same.

Furthermore, it is possible for the second fixing component 40 of the bat of example three shown in FIG. 7 and FIG. 8 to not have the protrusion part 43 shown in example two and be fixed only by the adhesive 70. The manufacturing method and effects in this case are the same as in example two and thus an explanation will be omitted here.

Second Embodiment

Figure 9A:
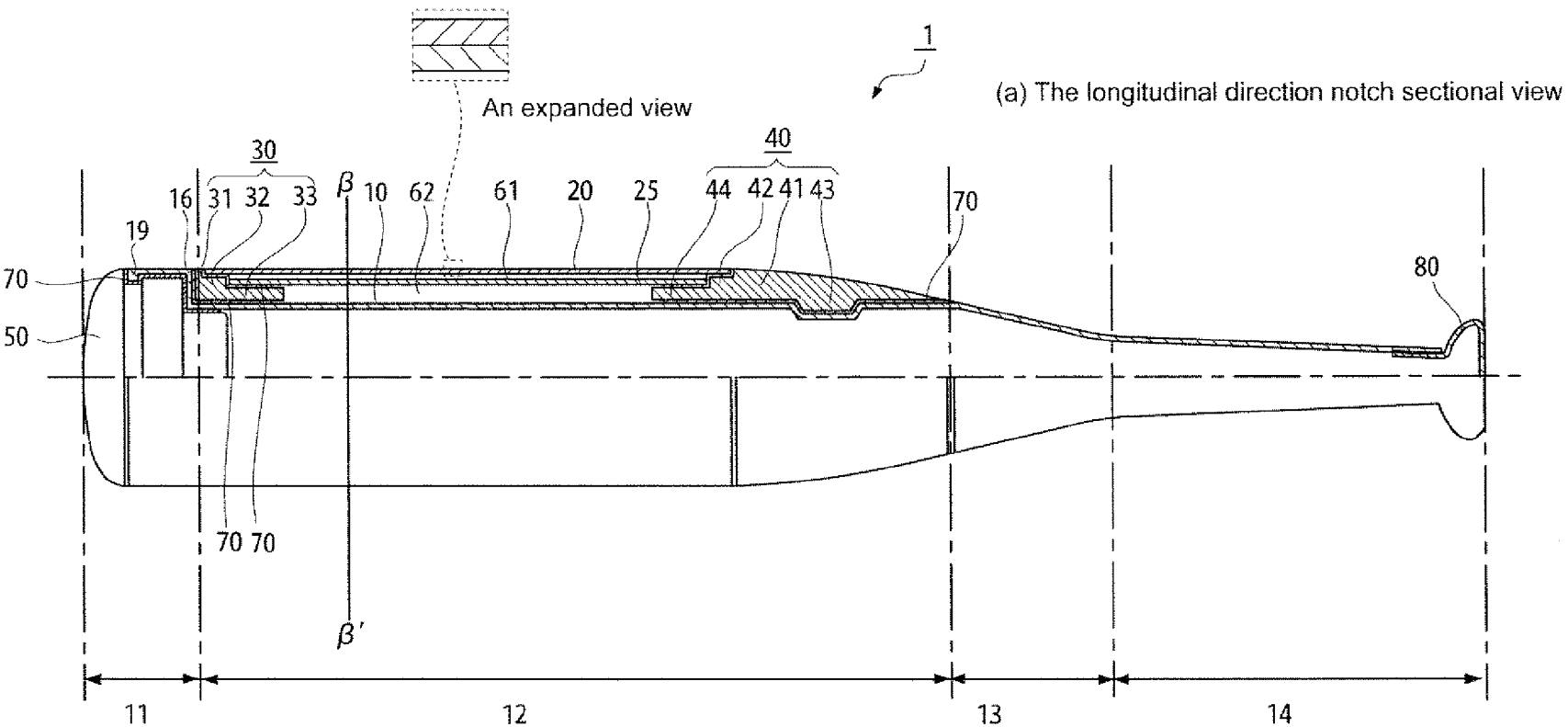
FIG. 9A is a longitudinal direction notch sectional view and a partial enlarged view of a second tube of a bat for baseball or softball related to embodiment two of the present invention.
Figure 9B:
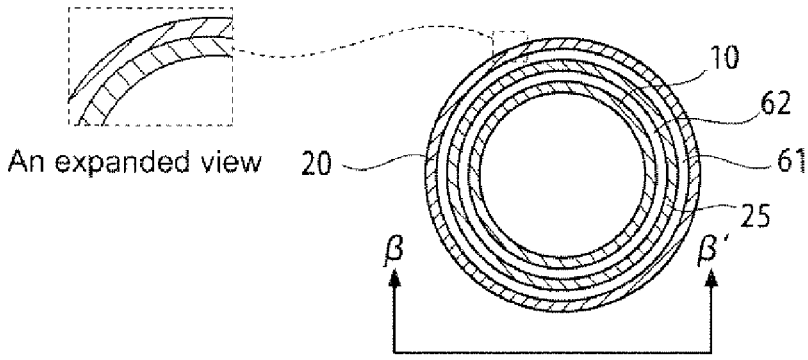
FIG. 9B is a cross sectional view of the line β-β' in a width direction and a partial enlarged view of a second tube of a bat for baseball or softball related to embodiment two of the present invention.

The bat 1 for baseball or softball related to embodiment two of the present invention will be explained. As stated above, the bat 1 for baseball or softball related to embodiment one of the present invention is a double layered bat which has a gap 60. By forming the bat by fixing two thin tubes so that the gap 60 is formed, and when the thin tubes bend inwards when a ball is hit it is possible to reduce consumption of impact energy as ball transformation energy and increase the flight distance of the ball. By forming a three layered structure by inserting a third tube 25 between the first tube 10 and second tube 20, it is possible to further reduce the thickness of each tube (10, 20, 25) respectively. In addition, by a synergistic effect of the bending of each tube (10, 20, 25) it is possible to further increase the flight distance of a ball. The bat 1 for baseball or softball related to embodiment two of the present invention is a three layered bat. FIG. 9A is a longitudinal direction notch sectional view and a partial enlarged view of a second tube of the bat 1 for baseball or softball related to embodiment two of the present invention. FIG. 9B is a cross sectional view of the line β-β' in a width direction and a partial enlarged view of a second tube of a bat for baseball or softball related to embodiment two of the present invention. Furthermore, in FIG. 9A, 9B, for the purposes of display, because the entire second tube 20 can not be displayed as a composite multi-layered structure, it is displayed as one layer in the overall diagram and as a composite multi-layered structure (a composite two layered structure in FIG. 9A, 98) in the partially expanded view.

As is shown in FIG. 9A, the bat 1 for baseball or softball related to embodiment two of the present invention is comprised of a first tube 10, a second tube 20, a third tube 25, a first fixing component 30, a second fixing component 40, cap 50 and a grip end 80 The third tube 25 is added to the bat 1 for baseball or softball related to embodiment one of the present invention and thus there is no large difference between the structure which is explained in the preferred embodiment. However, because the structure of the first fixing component 30 and second fixing component 40 has been changed to correspond with the three layered bat, this point will be explained in detail. Furthermore, because the same parts as those of the bat 1 for baseball or softball related to embodiment one of the present invention have the same symbols, an explanation will be omitted here.

The first fixing component 30 of the bat 1 for baseball or softball related to embodiment two includes a second body part 33 in addition to a body part 31 and a flange part 32 in order to latch the two exterior tubes (second tube 20 and third tube 25) of the three layered bat. In addition, the second fixing component 40 of this part also includes a second insertion part 44 in addition to a base part 41, an insertion part 42 and a protrusion part 43. The body part 31 and the insertion part 42 have a certain first height and the second body part 33 and second insertion part 44 have a certain second height.

Here, the second height is equal to the height of a second gap 62 which is formed between the first tube 10 and the third tube 25. In addition, the first height is equal to a height in which the height from the exterior of the first tube 10 up to the exterior of the third tube 25 is added to the height of a first gap 61 which is formed between the third tube 25 and the second tube 20. Furthermore, these equivalent heights are a result of considering the height in the case where the adhesive 70 which hardens between each tube (10, 20, 25) and the first fixing component 30 or the second fixing component 40. Furthermore, the height of the first gap 61 and the second gap 62 is appropriately set according to the material of the first tube 10, the second tube 20 and the third tube 25. In the embodiment two, the second height is set between, for example, 0.1 mm and 3.0 mm or more preferably between 0.3 mm and 0.5 mm. The first height is larger than the exterior diameter of the third tube 25 and is set within 6.0 mm or more preferably between 0.6 mm and 1.0 mm.

The first tube 10 of the three layered bat related to the second embodiment is formed from the same FRP or synthetic resin as that of embodiment one described above. C-FRP, B-FRP and K-FRP can be appropriately used as FRP, however, C-FRP is preferable. Because the formation method of the first tube 10 is the same as in embodiment one of the present invention described above an explanation will be omitted here.

The second tube 20 is cylindrical tube with both ends open and which has a composite multi-layer structure comprised of an inner layer and an outer layer the same as in embodiment one described above. Because the material of the inner layer and the outer layer is the same as in embodiment one described above an explanation is omitted here. The inner layer and outer layer are formed separately and are joined together by a press fit processing or the adhesive 70 which forms a composite multi-layer structure. Furthermore, in the case where the inner layer and outer layer are formed from metal, stress is released by performing a heat process after formation. Because the bat has a three layered structure which includes the third tube 25, the thickness of the inner layer and outer layer is set thinner than the second tube 20 of the bat related to embodiment one of the present invention and is set according to the material used and the range within which a required strength and rigidity can be secured in the first tube 10, second tube 20 and third tube 25.

The third tube 25 is a cylindrical tube in which both ends are open bends inwards together with the second tube 20 when a ball is hit and plays the role of reducing consumption of impact energy as ball transformation energy. The third tube 25 may be formed from FRP and may also be formed from metal. As an FRP, C-FRP, B-FRP or K-FRP may be used. As a metal, aluminum, aluminum alloy, aluminum-scandium alloy, scandium alloy, titanium, titanium alloy, magnesium alloy or steel alloy may be used. In the case where a bat which must be light such as a child's bat or girl's bat is requested, C-FRP may be preferably used in order to achieve lightness over the entire bat.

Because the bat has a three layered structure, it is sufficient if a certain strength and rigidity is secured across the entire bat, and the thickness of the three tubes are each set thinner than the thickness of each of the double layered bat. In addition, weight can be reduced across the entire bat.

By making the bat 1 for baseball or softball related to embodiment two a three layered structure it is possible to further reduce the thickness of each exterior tube and it is also possible to further improve the flight distance of a ball by a synergistic effect of the bending of each of the tubes. In addition, the effects of improving safety, increasing the length of the life cycle of the bat compared to a hybrid type bat, improving rigidity of the bat tip part and increasing durability, are the same as the above stated embodiment one.

Furthermore, the bat 1 for baseball or softball related to embodiment two can also be transformed into example one, example two and example three of the bat for baseball or softball related to embodiment one stated above. That is, the tip part 11 is formed by the first tube 10 and the cap 50 may be omitted, the protrusion part 43 is omitted and the second fixing component 40 may be easily fixed. Furthermore, it is possible to omit the first fixing component 30 by forming a first step part 17*a*, a second step part 17*b*, a first connecting part 18*a* and a second connecting part 18*b*. While these two step parts (17*a* and 17*b*) and connecting parts (18*a* and 18*b*) are formed, because their formation is achieved by a change of metal mold there is no effect on the manufacturing process such as an increase in processes. In addition, the effects of each are the same as the transformation example of the bat for baseball or softball related to embodiment one.

Embodiment Three

Figure 10A:
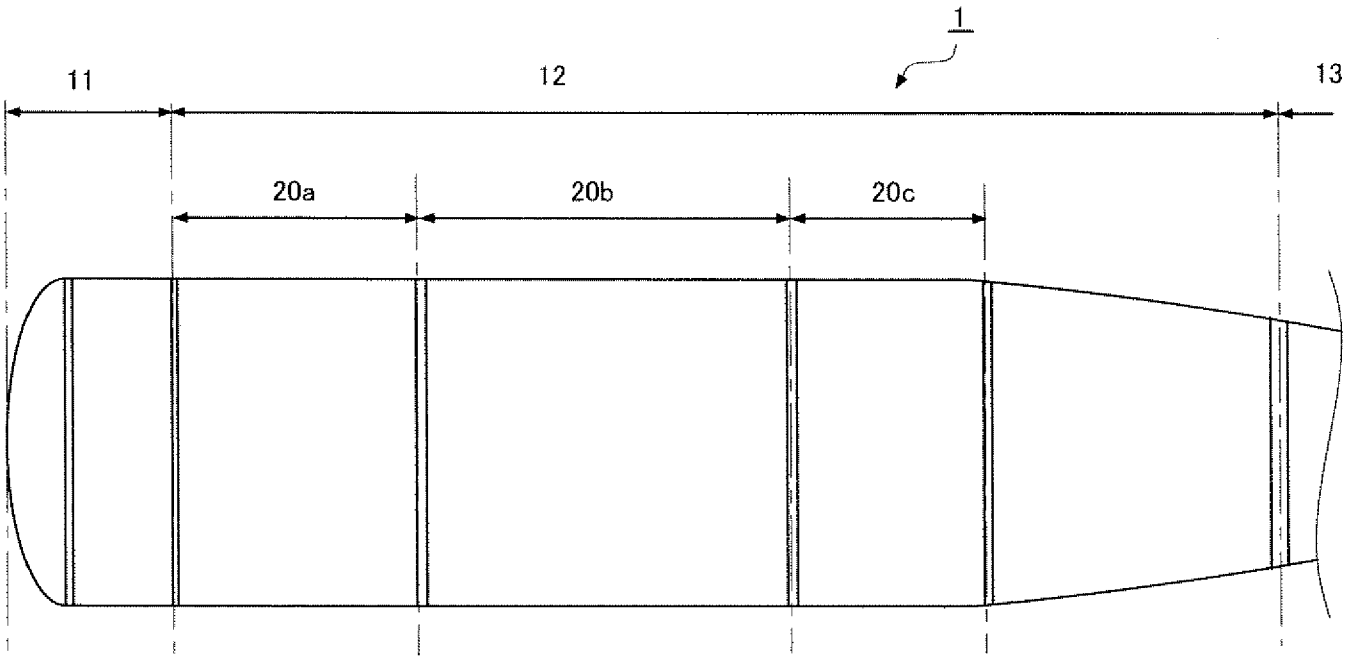
FIG. 10A is a longitudinal direction surface view of a bat for baseball or softball related to embodiment three of the present invention.
Figure 10B:
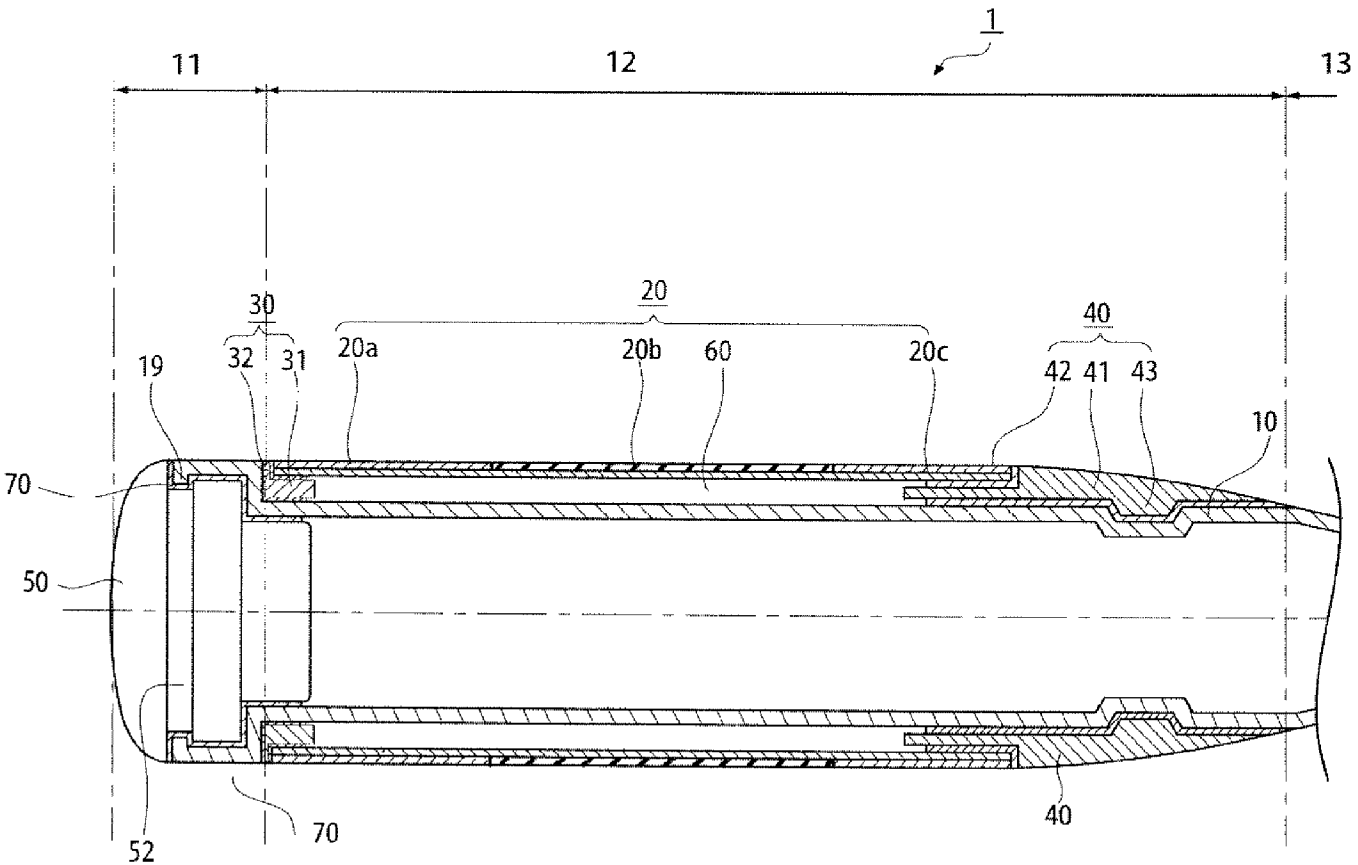
FIG. 10B is a longitudinal direction notch cross sectional view of a bat for baseball or softball related to embodiment three of the present invention.

The bat 1 for baseball or softball related to embodiment three of the present invention will be explained. By using a material which has excellent rebound characteristics for the material of the outer layer of the second tube 20 which has a composite multi-layered structure, for example, titanium or a titanium alloy, the bat is further formed to improve the flight distance of a ball. However, this titanium or titanium alloy is expensive and if the entire second tube 20 is formed form titanium or a titanium alloy, manufacturing costs increase significantly. Therefore, if the outer layer of the second tube 20 is formed from a plurality of tubes and titanium or a titanium alloy is used only on a sweet-spot which is the center of an impact with a ball, then an increase in costs can be controlled. The bat 1 for baseball or softball related to embodiment three is a bat which has a double layered structure in which an outer layer of the second tube 20 has a composite multi-layered structure. FIG. 10A is a longitudinal direction surface view of a bat 1 for baseball or softball related to embodiment three of the present invention. FIG. 10B is a longitudinal direction notch cross sectional view of a bat for baseball or softball related to embodiment three of the present invention.

As is shown in FIG. 10B, the bat 1 for baseball or softball related to embodiment three is comprised of a first tube 10, a second tube 20, a first fixing component 30, a second fixing component 40, a cap 50 and a grip end 80. The, outer layer of the second tube 20 is comprised of several parts (In FIG. 10B, the case where it is comprised of three parts is shown as an example). The inner layer of the second tube 20 is one tube formed from metal or FRP the same as in the above described embodiment one. A plurality of outer layers are each attached and fixed via the adhesive 70 to the exterior periphery of the inner layer which is one tube and forms the second tube 20 as one tube. Alternatively, the second tube 20 is formed by press fitting the inner layer to the plurality of outer layers which are alternately attached in a longitudinal direction. In FIG. 10B each part of the second tube 20 which is formed as one body are called a second tube first part 20*a*, a second tube second part 20*b* and a second tube third part 20*c* each of which correspond to a different outer layer. Because the first tube 10, the first fixing component 30, the second fixing component 40, the cap 50 and the grip end 80 are the same as in the bat 1 for baseball or softball related to embodiment one explained above, the same symbols are attached to the same parts and thus an explanation is omitted here.

In the present embodiment, each outer layer of the second tube first part 20*a* and the second tube third part 20*c* is formed from aluminum, aluminum alloy, aluminum-scandium alloy, scandium alloy, steel alloy, FRP or a wood material. From the viewpoint of ease of processing and cost, an A7000 aluminum alloy such as aluminum alloy AA7050, AA7046 regulated under the American Aluminum Association Regulation, aluminum-scandium alloy or scandium alloy is preferable. However, because the outer layer of the second tube second part 20*b* is the part which is equivalent to what is called the sweet-spot where the ball travels furthest when hit, it is formed from high cost titanium or a titanium alloy which has excellent rebound characteristics. The second tube second part 20*b* may also be formed from a magnesium alloy. The plurality of outer layers of the second tube 20 are cylindrical and each tube is formed with both ends open and each heat treated separately and used once stress is released. Furthermore, either the outer layer of the second tube second part 20*a* or the outer layer of the second tube third part 20*c* may be formed from the same material as the outer layer of the second tube second part 20*b*. As a result, at least the outer layer of one of the three second tube second parts (20*a*, 20*b*, 20*c*) is formed from a different material to the other two outer layers. In addition, the thickness of each part of the three second tube second parts (20*a*, 20*b*, 20*c*) is formed to the same thickness.

In this way, the outer layer of the second tube 20 which has a composite multi-layer structure is formed from parts which have different materials and by interlocking one inner layer the second tube 20 is formed as one tube in which the exterior is comprised of a plurality of different materials. Therefore, in the case of a double layered bat, by fixing both ends of the second tube 20 by the first fixing component 30 and the second fixing component 40 it becomes possible to easily form a gap with a desired height between the first tube 10 and the second tube 20. In the Japanese Laid Open Patent 2008-29620, the structure of a similar double layered bat having a plurality of second tubes is disclosed, however, the bat shown in Japanese Laid Open Patent 2008-29620 requires another fixing component for fixing one end or both ends of the plurality of second tubes. Because the bat related to embodiment three does not require another fixing component it can be easily manufactured compared to the bat shown in Japanese Laid Open Patent 2008-29620.

In the bat 1 for baseball or softball related to embodiment three of the present invention which has the structure explained above, by arranging the second tube second part 20*b* which is formed from titanium or a titanium alloy having excellent rebound characteristics only in a sweet-spot position which when hit can increase the flight distance of a ball, it is possible to reduce an increase in manufacturing costs even if expensive titanium or a titanium alloy is used. In addition, it is possible to form the other parts of the second tube (20*a*, 20*c*) with a cheaper metal such as a steel alloy and thus it is possible to propose a double layered bat in which manufacturing costs can be easily reduced Furthermore, the second tube second part 20*b* which has excellent rebound characteristics is arranged only on the sweet-spot part and the other parts of the second tube (20*a*, 20*c*) for example, can be formed with a metal which has poorer rebound characteristics than an aluminum alloy or a steel alloy. In this case, the bat becomes a bat in which a ball does not travel as far if hit in a place other than this sweet-spot, however, this bat can be preferably used as a practice bat for batting skill acquisition.

In addition, the effects of increasing the flight distance of a ball by a double layered structure, reducing operational processes, improving safety, increasing the length of the life cycle of the bat compared to a hybrid type bat, making the entire bat lighter, improving vibration damping effects and reducing hand pain, increasing durability and improving rigidity of the bat tip part, are the same as in the above stated embodiment one and embodiment two of the present invention. Furthermore, a transformed example is possible as in embodiment one and embodiment two of the present invention stated above wherein the cap 50 can be omitted by forming the tip part 11 with the first tube 10, omitting the protrusion part 43 of the second fixing component 40 and easily latching the second fixing component 40, and omitting the first fixing component 30 by forming the step part 17 on the first tube 10. In addition, each of these effects is the same as in the transformed examples of the bat for baseball or softball related to embodiment one stated above.

Embodiment Four

Figure 11A:
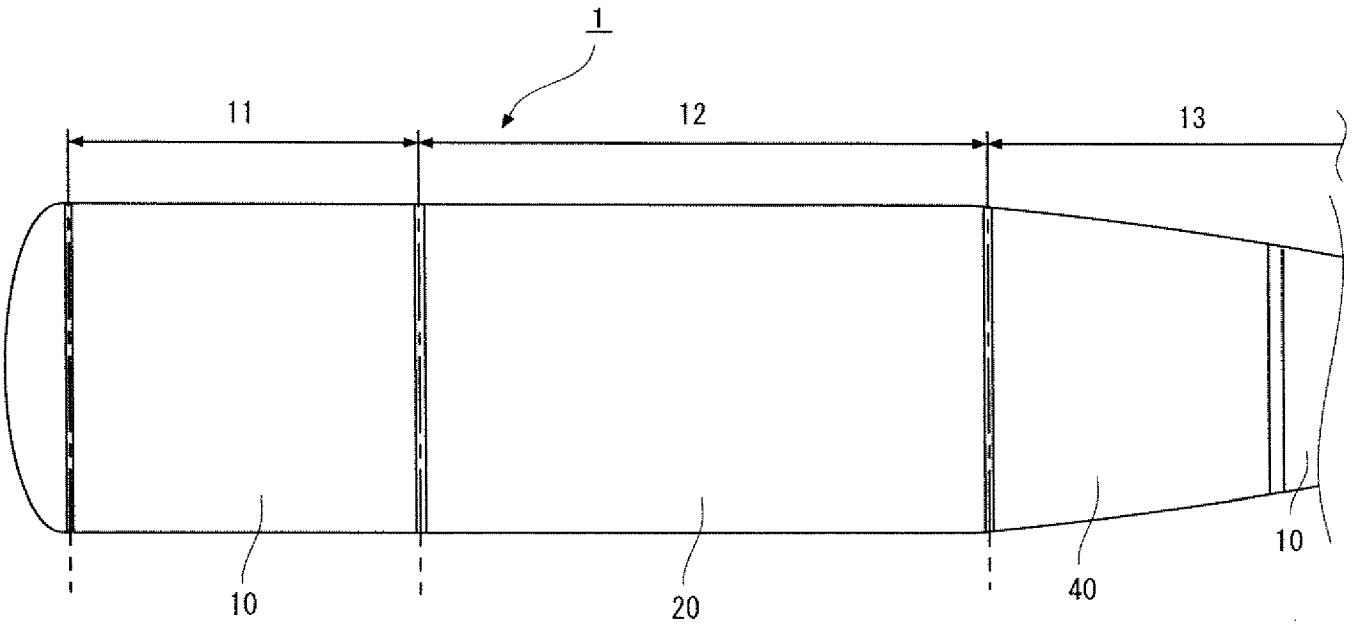
FIG. 11A is a longitudinal direction surface view of a bat for baseball or softball related to embodiment four of the present invention.
Figure 11B:
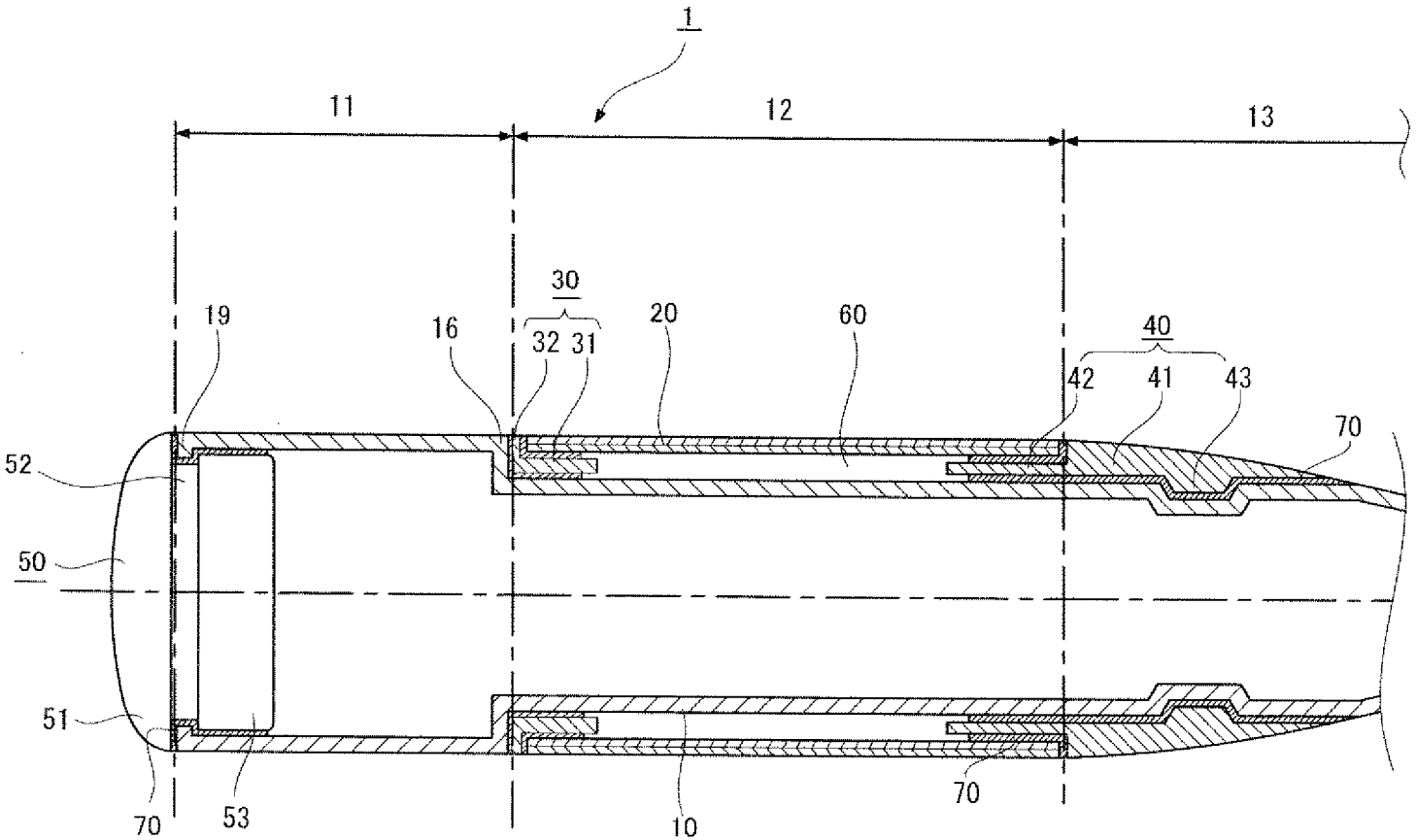
FIG. 11B is a longitudinal direction cross sectional view of a bat for baseball or softball related to embodiment four of the present invention.

Next, the bat 1 for baseball or softball related to embodiment four of the present invention will be explained. As stated above, the outer layer of the second tube 20 in the double layered bat related to embodiment three of the present invention is comprised of a plurality of tubes and the second tube 20*b* which is formed from titanium or a titanium alloy having excellent rebound characteristics, is arranged in the sweet-spot position. In the bat 1 for baseball or softball related to embodiment four of the present invention, the arrangement of the second tube 20 which is formed from titanium or a titanium alloy having excellent rebound characteristics in the sweet-spot position is the same as in embodiment three, however, in embodiment four this second tube 20 is comprised from one inner layer and one outer layer. That is, the structure of the second tube 20 is the same as the bat related to embodiment one. FIG. 11A is a longitudinal direction surface view of the bat 1 for baseball or softball related to embodiment four of the present invention. FIG. 11B is a longitudinal direction cross sectional view of a bat for baseball or softball related to embodiment four of the present invention.

As is shown in FIG. 11, the bat 1 for baseball or softball related to embodiment four of the present invention is comprised of a first tube 10, a second tube 20, a first fixing component 20, a second fixing component 40, a cap 50 and a grip end 80. Characteristically, the length of the second tube 20 is short, while the tip part 11 of the first tube 10 is formed so that it extends as far as a position of the sweet-spot. In this way, it is possible to make the length of the second tube 20 shorter and arrange the second tube 20 only in the position of the sweet-spot. Furthermore, the cap 50 does not have the cap second fixed part 54 shown in FIG. 1. Because the other parts are the same as in embodiment one described above, the same parts have the same symbols and therefore an explanation is omitted here.

Because the formation method of the first tube 10 of the bat related to embodiment four is the same as the bat 1 for baseball or softball related to embodiment one of the present invention, a detailed explanation is omitted. However, because the formation of the mandrel is different it will be explained. In the mandrel which is used when forming the bat 1 for baseball or softball related to embodiment four, the distance from a place equivalent to the curled part 19 to a place equivalent to the stopper part 16 is set at least the same or more than a predetermined distance. This predetermined distance can be appropriately adjusted according to the position of the sweet-spot of the bat which is manufactured and is set at least 100 mm or more from the end tip side of the tip part. Therefore, the first tube 10 which is formed by winding an FRP prepreg using this mandrel is a shape which extends at the same diameter from the curled part 19 to the stopper part 16. As a result, as shown in FIG. 11, the bat tip part 11 can be formed longer compared to the bat related to embodiment one. The method of fixing the second tube 20 using the first fixing component 30 and the second fixing component 40 is the same as in embodiment one.

The bat related to embodiment four having the above described structure has a structure in which the second tube 20 is only attached to the position of the sweet-spot as can be judged from the notch cross section in FIG. 11(*b*). Therefore, because a tube which is formed from titanium or a titanium alloy as a material of the outer layer of the second tube 20 having excellent rebound characteristics is used only on the part which makes a ball travel far when hit, an increase in manufacturing costs can be reduced.

In addition, the effects of increasing the flight distance of a ball by a double layered structure having a desired gap 60, improving rigidity of the bat tip part, improving safety, improving vibration damping effects and reducing hand pain, increasing the length of the life cycle of the bat compared to a hybrid type bat and increasing durability are the same as in the bat in the above stated embodiment one, embodiment two and embodiment three of the present invention Furthermore, the bat related to the present embodiment can be transformed as an example the same as in the above stated example one and example three of embodiment one of the present invention. The effects in this case are also the same. In addition, as explained in embodiment three, the first tube 10 can be formed from a metal which has poorer rebound characteristics than an aluminum alloy or a steel alloy and can be used as a practice bat for batting skill acquisition. The effects in this case are also the same.

What is claimed is:

1. A bat for baseball or softball comprising:

a first tube formed from FRP or synthetic resin having a grip part, a taper part, a part to be hit, a tip part, and a stopper part formed by gradually opening said first tube from said part to be hit side towards said tip part side, and a hollow for latching having a groove shape formed by reducing the diameter of said first tube;

a cylindrical second tube having two ends which are open, and having an interior diameter which is larger than an exterior diameter of said part to be hit and smaller than an exterior diameter of said stopper part, said second tube including at least two or more layers;

a first fixing component having a donut shape and including a body part and a flange part, said flange part having a larger exterior diameter than an exterior diameter of said body part, and said first fixing component having an opening larger than an exterior diameter of said part to be hit, and an interior periphery surface of said body part being fixed to said first tube and one surface of said flange part being fixed to said stopper part;

a second fixing component having a donut shape and including a base part and an insertion part, said insertion part having a smaller exterior diameter than the largest exterior diameter of said base part, and also including a protrusion part which protrudes inwards and an opening which is larger than an exterior diameter of said part to be hit, said protrusion part being fixed by interlocking with said hollow for latching, and;

a gap located between said first tube and said second tube and being formed by said second tube being attached to an exterior periphery of said first tube, one end of said second tube being fixed to an exterior periphery surface of said body part, and the other end of said second tube being fixed to said insertion part which is inserted between said first tube and said second tube.

2. The bat for baseball or softball according to claim 1, wherein said second tube is formed as one body from an inner layer formed from metal or FRP, and at least one or more outer layers formed from either of metal, FRP or wood and being attached to an exterior periphery of said inner layer.

3. The bat for baseball or softball according to claim 2, wherein said outer layer of said second tube is formed from a combination of a first part formed from metal and one or more second parts formed from either of metal which is different said metal, FRP or wood, and at least one of said first part and said one or more second parts being formed from a different material to the other part.

4. The bat for baseball or softball according to claim 2, further comprising a cap, said cap including a cap tip part, a cap recessed part and a cap fixing part, said tip part including a curled part in which a tip of said tip part curves inwards, and an exterior diameter of said cap fixing part being smaller than an interior diameter of said first tube from said curled part as far as said stopper part, and an exterior diameter of said cap recessed part being smaller than an interior diameter of said curled part, and said cap recessed part being latched by said curled part.

5. The bat for baseball or softball according to claim 2, wherein said tip of said tip part curves inwards and is closed.

6. The bat for baseball or softball according to claim 2, wherein said first tube further includes a step part having an exterior diameter which is smaller than an exterior diameter of said stopper part and larger than an exterior diameter of said part to be hit, and a gap located between said first tube and said second tube and being formed by said second tube being attached to an exterior periphery of said first tube, one end of said second tube being fixed to said step part and the other end of said second tube being fixed to said insertion part which is inserted between said first tube and said second tube.

7. The bat for baseball or softball according to claim 2, wherein said first tube includes a grip part, a taper part, a part to be bit, a tip part and a stopper part formed by opening of said first tube towards said tip part side from said part to be hit side, and said second fixing component includes a base part and an insertion part which has a smaller exterior diameter than a largest diameter of said base part, said second fixing component being fixed to an exterior periphery of said first tube via an adhesive, and a gap located between said first tube and said second tube and being formed by said second tube being attached to an exterior periphery of said first tube, one end of said second tube being fixed to an exterior periphery surface of said body part, and the other end of said second tube being fixed to said insertion part which is inserted between said first tube and said second tube.

8. The bat for baseball or softball according to claim 2, wherein said first tube is formed from either C-FRP, B-FRP, K-FRP or synthetic resin and an inner layer of said second tube is formed from either aluminum, an aluminum alloy, titanium, a titanium alloy, a magnesium alloy, an aluminum-scandium alloy, a scandium alloy, a steel alloy or FRP, and an outer layer of said second tube is formed from either aluminum, an aluminum alloy, titanium, an titanium alloy, a magnesium alloy, an aluminum-scandium alloy, a scandium alloy, a steel alloy, FRP or wood.

9. The bat for baseball or softball according to claim 2, wherein said stopper part is formed in a position of said part to be hit side at least 100 mm or more from a tip of said tip part, and said second tube is arranged in the best position for an impact.

10. The bat for baseball or softball according to claim 2, further comprising a grip end, said grip end being either fixed to said first tube by a screw or an adhesive, or being formed as one body with said first tube.

11. A bat for baseball or softball comprising:

a first tube formed from FRP or synthetic resin having a grip part, a taper part, a part to be hit, a tip part, and a stopper part formed by gradually opening said first tube from said part to be hit side towards said tip part side, and a hollow for latching having a groove shape formed by reducing the diameter of said first tube;

a cylindrical second tube having two ends which are open, and having an interior diameter which is larger than an exterior diameter of said part to be hit and smaller than an exterior diameter of said stopper part, said second tube including at least two or more layers;

a cylindrical third tube having two ends which are open and having a larger exterior diameter than an exterior diameter of said first tube and a smaller exterior diameter than an exterior diameter of said second tube;

a first fixing component having a donut shape and including a body part and a flange part, said flange part having a larger exterior diameter than an exterior diameter of said body part, and said first fixing component having an second body part which has a smaller exterior diameter than an exterior diameter of said body part and being formed so that it protrudes in an opposite direction of said flange part from said body part, and an opening larger than an exterior diameter of said part to be hit, a second fixing component having a donut shape and including a base part and a first insertion part, said first insertion part having a smaller exterior diameter than the largest exterior diameter of said base part, and also including a protrusion part which protrudes inwards, and a second insertion part having a smaller exterior diameter than said exterior diameter of said first insertion part and being formed so that it protrudes in an opposite direction of said base part from said first insertion part, and an opening which is larger than an exterior diameter of said part to be hit, said protrusion part being fixed by interlocking with said hollow for latching;

a first gap located between said first tube and said third tube and being formed by said third tube being attached to an exterior periphery of said first tube, one end of said third tube being fixed to an exterior periphery surface of said second body part, and the other end of said third tube being fixed to said second insertion part which is inserted between said first tube and said third tube, and;

a second gap located between said third tube and said second tube and being formed by said second tube being attached to an exterior periphery of said third tube, one end of said second tube being fixed to an exterior periphery surface of said body part, and the other end of said second tube being fixed to said first insertion part which is inserted between said third tube and said second tube.

12. The bat for baseball or softball according to claim 11, wherein said second tube is formed as one body from an inner layer formed from metal or FRP, and an outer layer attached to an exterior periphery of said inner layer and formed from at least one of metal, FRP or wood.

13. The bat for baseball or softball according to claim 12, wherein said outer layer of said second tube is formed from a combination of a first part formed from metal, and one or more second parts formed from one of a metal which is different to said metal, FRP or wood, and at least one of said first part and said one or more second parts being formed from a different material to the other part.

14. The bat for baseball or softball according to claim 13, further comprising a cap, said cap including a cap tip part, a cap recessed part and a cap fixing part, said bat tip part including a curled part in which a tip of said tip part curves inwards, and an exterior diameter of said cap fixing part being smaller than an interior diameter of said first tube from said curled part as far as said stopper part, and an exterior diameter of said cap recessed part being smaller than an interior diameter of said curled part, and said cap recessed part being latched by said curled part.

15. The bat for baseball or softball according to claim 12, wherein said tip of said tip part curves inwards and is closed.

16. The bat for baseball or softball according to claim 12, wherein said first tube further includes a first step part having an exterior diameter which is smaller than an exterior diameter of said stopper part, and a second step part which having a smaller exterior diameter than an exterior diameter of said first step part and a larger exterior diameter than an exterior diameter of said part to be hit, and a first gap located between said first tube and said third tube and being formed by said third tube being attached to an exterior periphery of said first tube, one end of said third tube being fixed to said second step part and the other end of said third tube being fixed to said second insertion part which is inserted between said first tube and said third tube, and a second gap located between said third tube and said second tube and being formed by said second tube being attached to an exterior periphery of said third tube, one end of said second tube being fixed to an exterior periphery surface of said first step part and the other end of said second tube being fixed to said first insertion part which is inserted between said third tube and said second tube.

17. The bat for baseball or softball according to claim 12, wherein said first tube only includes a grip part, a taper part, a part to be bit, a tip part and a stopper part formed by opening of said first tube towards said tip part side from said part to be hit side, and said second fixing component includes a base part, a first insertion part which has a smaller exterior diameter than the largest diameter of said base part, and a second insertion part which has a smaller exterior diameter than an exterior diameter of said first insertion part and being formed so that it protrudes in an opposite direction of said base part from said first insertion part, said second fixing component being fixed to an exterior periphery of said first tube via an adhesive, and a first gap located between said first tube and said third tube and being formed by said third tube being attached to an exterior periphery of said first tube, one end of said third tube being fixed to an exterior periphery surface of said second body part, and the other end of said third tube being fixed to said second insertion part which is inserted between said first tube and said third tube, and a second gap located between said third tube and said second tube and being formed by said second tube being attached to an exterior periphery of said third tube, one end of said second tube being fixed to an exterior periphery surface of said body part, and the other end of said second tube being fixed to said first insertion part which is inserted between said third tube and said second tube.

18. The bat for baseball or softball according to claim 12, wherein said first tube is formed from either C-FRP, B-FRP, K-FRP or synthetic resin, and an inner layer of said second tube and said third tube are formed from either aluminum, an aluminum alloy, titanium, a titanium alloy, a magnesium alloy, an aluminum-scandium alloy, a scandium alloy, a steel alloy or FRP, and an outer layer of said second tube is formed from either aluminum, an aluminum alloy, titanium, a titanium alloy, a magnesium alloy, an aluminum-scandium alloy, a scandium alloy, a steel alloy, FRP or wood.

19. The bat for baseball or softball according to claim 12, further comprising a grip end, said grip end being either fixed to said first tube by a screw or an adhesive, or being formed as one body with said first tube.

* * * * *